US009642422B2

(12) United States Patent
Haller

(10) Patent No.: US 9,642,422 B2
(45) Date of Patent: May 9, 2017

(54) UMBRELLA WIRE FRAME

(71) Applicant: John L. Haller, San Diego, CA (US)

(72) Inventor: John L. Haller, San Diego, CA (US)

( * ) Notice: Subject to any disclaimer, the term of this patent is extended or adjusted under 35 U.S.C. 154(b) by 0 days.

(21) Appl. No.: 14/547,577

(22) Filed: Nov. 19, 2014

(65) Prior Publication Data

US 2016/0135556 A1 May 19, 2016

(51) Int. Cl.
*A45B 25/02* (2006.01)

(52) U.S. Cl.
CPC ..... *A45B 25/02* (2013.01)

(58) Field of Classification Search
CPC ..... A45B 25/02
USPC ..... 135/19, 5, 31, 15.1
See application file for complete search history.

(56) References Cited

U.S. PATENT DOCUMENTS

| | | | | | |
|---|---|---|---|---|---|
| 19,998 | A | | 4/1858 | Kurth | |
| 145,733 | A | * | 12/1873 | Griswold | A45B 25/02 135/30 |
| 1,290,245 | A | | 1/1919 | Kuehner | |
| 1,316,421 | A | * | 9/1919 | Cannon, Jr. | A45B 25/02 135/15.1 |
| 1,749,363 | A | | 8/1926 | Venner, Jr. | |
| 2,024,946 | A | * | 12/1935 | Morgenstern | A45B 25/02 135/15.1 |
| 2,474,516 | A | * | 6/1949 | Daniel | A45B 23/00 135/15.1 |
| 2,561,435 | A | | 11/1949 | Woodward | |
| 2,492,376 | A | * | 12/1949 | Brillas | A45B 25/02 135/15.1 |
| 2,517,827 | A | * | 8/1950 | Balsam | A45B 25/00 135/126 |
| 2,640,490 | A | * | 6/1953 | Kramer | A45B 13/00 135/15.1 |
| 3,021,985 | A | | 11/1959 | Sarver | |
| 3,467,114 | A | * | 9/1969 | McSherry | A45F 4/00 135/126 |
| 4,361,982 | A | | 12/1982 | Horowitz | |

(Continued)

FOREIGN PATENT DOCUMENTS

GB 655269 A * 7/1951 ..... A45B 19/10

OTHER PUBLICATIONS

Shadeforplants, Photo of Shade Dot (Shade for Plants), by Little Gree Company/Shadeforplants.com, Dave's Garden, Feb. 20, 2015, 2, Internet Brands.

(Continued)

*Primary Examiner* — Noah Chandler Hawk
(74) *Attorney, Agent, or Firm* — Gordon Rees Scully Mansukhani LLP; David R. Heckadon

(57) ABSTRACT

An umbrella frame has a post, a number of arms, a number of connecting rods, a lift ring and a ring lock. The post has a number of aligned wire elements connected to each other along their length with a number of post spacers. Each arm has at least two aligned wire elements connected together along their length with a number of arm spacers. Each arm is connected to the top of the post and rotates upward from a closed position along the post to an upward open position and back. The lift ring slides up and down the post to open and close the umbrella frame. Each connection rod is connected to the lift ring at one end and the other end to a mid-point on each respective arm. The ring lock secures the lift ring to the post in the open position.

5 Claims, 23 Drawing Sheets

(56) References Cited

U.S. PATENT DOCUMENTS

| | | | | |
|---|---|---|---|---|
| 4,597,221 | A | 7/1986 | Adair et al. | |
| 4,942,693 | A | 7/1990 | Sibold | |
| 5,135,016 | A | 8/1992 | Stiller | |
| 5,158,102 | A | 10/1992 | Lemcke | |
| 6,314,976 | B1 | 11/2001 | Clarke | |
| 6,862,843 | B2 | 3/2005 | Missry | |
| D513,117 | S | 12/2005 | Raede | |
| 9,138,035 | B2 * | 9/2015 | Stochetti | A45B 19/00 |
| 2006/0207639 | A1 | 9/2006 | Ko | |
| 2007/0089769 | A1 | 4/2007 | Li | |
| 2008/0092440 | A1 | 4/2008 | Johnson | |
| 2010/0107488 | A1 | 5/2010 | King et al. | |
| 2013/0048038 | A1 * | 2/2013 | Herrera | A45B 11/00 135/31 |

OTHER PUBLICATIONS

Foobear, Seed Umbrellas, Instructables, Feb. 20, 2015, 9.
John Takai, An Image of a Potted Plants Shadded by Umbrellas, 123rf.com, Feb. 20, 2015, 3.
Plant Supports and Stages on Pintrerest, Pinterest, 20/20/2015, 2.
Sofie De Graaf, Garden, Pintrest, Feb. 20, 2015, 4.
Umbrella for Plants, Umbrella for Pants Suppliers and manufacturers, Alibaba, Feb. 20, 2015, 7.

* cited by examiner

UMBRELLA WIRE FRAME

FIELD OF THE INVENTION

This invention relates to an umbrella and an umbrella frame. More particularly, the present application involves an umbrella frame comprising of a post, arms, modular connectors, a lift ring and a locking element wherein the post, arms, modular connectors may be rigid multiple spaced multiple wires.

BACKGROUND OF THE INVENTION

Umbrellas are widely used for personal or garden protection. There are a variety of umbrellas available in the market which are used to protect a user from rain, sun and and/or wind. An umbrella is basically made up of a frame and a fabric cover fixed to the top section of an umbrella. A basic umbrella frame essentially comprises of a rigid shaft and a plurality of ribs or spokes attached to the top of the central shaft. There is a movable element provided along the central rigid shaft for moving up and down to facilitate the opening and closing of the umbrella.

In the umbrella system retail market, umbrellas are categorized on the basis of their size, durability, maintainability and mechanical strength. These are the important parameters to determine an umbrella's suitability for use in a particular environment and for a particular customer.

There have been reported numerous cases where the umbrella structure has collapsed or broken due to use over time or in extreme and challenging environments. For example, umbrellas can be damaged by severe and unexpected weather and strong winds, which can cause component parts of the umbrella frame to become cracked or bent. Others suffer damage as a result of improper handling, such as while transporting them from one location to another quickly or recklessly and/or as a result of improper installation. Many of the umbrellas known in the art suffer the disadvantages of not being able to withstand strong winds or other harsh weather, as well as not being capable of simple repair when damage does occur. Such cases happen due to the use of downgrade material in umbrella manufacture and more importantly due to faulty umbrella designs which have relatively weaker mechanical strength.

Henceforth, the strength of the umbrella frame is of much importance to a user, since in extreme wind conditions or other scenarios where the strength of the umbrella frame is to be tested a stronger and mechanically stable umbrella assembly provides a better service to the end user and a longer operational life. There have been a number of attempts to increase the strength of an umbrella frame by using reinforcements, accessories along the ribs or spokes to provide a stronger system. However, much has not been achieved since the use of additional parts have resulted in increase of weight, complex design and made the umbrella less desirable to be used frequently.

Thus, there exists a need for an umbrella frame having a strong and stable mechanical assembly which can provide to the user complete value and satisfaction with an efficient and longer operational life.

SUMMARY OF THE INVENTION

It is an object of the present invention to provide an umbrella frame comprising a post having a top end and a bottom end, a plurality of arms coupled to the post proximally at its top end, a movable lift ring mounted circumferentially around the post and a plurality of modular connectors each having a first end and a second end, wherein the first end is connected at an intermediate location of an arm and the second end is connected to the lift ring and wherein the post comprises of a plurality of first wires bound to each other with a plurality of first spacers and each arm comprises of a plurality of second wires bound to each other with a plurality of second spacers.

It is an another object of the present invention to provide an umbrella frame wherein the first spacers and second spacers are located inside, outside or in-between the plurality of first wires and the second wires.

It is still another object of the present invention to provide an umbrella frame wherein the first wires are longitudinally joined to each other without the use of first spacers.

It is yet another object of the present invention to provide an umbrella frame wherein the first spacers and the second spacers can be ball bearings.

It is yet another object of the present invention to provide an umbrella frame wherein the first wires and the second wires are half bent wires.

It is yet another object of the present invention to provide an umbrella frame wherein the first spacers can be cylindrical blocks or plugs fixed along the length of the post.

It is yet another object of the present invention to provide an umbrella frame wherein the second wires are oriented in a vertical plane or in a horizontal plane with respect to each other.

It is yet another object of the present invention to provide an umbrella frame wherein the lift ring is a circular ring with a plurality of loops or bumps.

It is yet another object of the present invention to provide an umbrella frame wherein the lift ring moves freely along the post to open and close the plurality of arms.

It is yet another object of the present invention to provide an umbrella frame wherein the post and the lift ring are locked by a locking element to keep open the plurality of arms.

It is yet another object of the present invention to provide an umbrella frame wherein the plurality of arms has a fabric cover affixed to them.

It is yet another object of the present invention to provide an umbrella frame wherein the first end of the modular connector is attached to the second spacer lying intermediately on one of the arms.

It is yet another object of the present invention to provide an umbrella frame wherein the first end of the modular connector is connected to a plurality of second wires at an intermediate location of one of the arms.

It is yet another object of the present invention to provide an umbrella frame wherein the modular connector comprises of a plurality of third wires bound to each other with a plurality of third spacers.

It is yet another object of the present invention to provide an umbrella frame comprising a post having a top end and a bottom end, a plurality of arms coupled to the post proximally at its top end, a movable lift ring mounted circumferentially around the post and a plurality of modular connectors each having a first end and a second end, wherein the first end is connected at an intermediate location of an arm and the second end is connected to the lift ring and wherein the post comprises of a plurality of first wires bound to each other with a plurality of first spacers and each arm includes a plurality of second wires bound to each other with a plurality of second spacers and the umbrella frame further having the post and the lift ring locked by a locking element to keep open the plurality of arms.

It is yet another object of the present invention to provide an umbrella frame comprising a post having a top end and a bottom end, a plurality of arms coupled to the post proximally at its top end wherein each arm comprises of a plurality of second wires; a plurality of modular connectors each having a first end and a second end, wherein the first end is fixedly attached at an intermediate location of an arm and the second end is fixedly attached to the post and wherein the post comprises of a plurality of first wires bound to each other with a plurality of first spacers.

It is yet another object of the present invention to provide an umbrella frame wherein the lock is mounted at the top end of the post to be hooked to the lift ring.

It is yet another object of the present invention to provide an umbrella frame wherein the lock is mounted on the lift ring and comprises of a chain and a pin.

It is yet another object of the present invention to provide an umbrella frame which can be easily folded.

It is yet another object of the present invention to provide an umbrella frame which has its arms rigidly fixed in open position.

It is yet another object of the present invention to provide an umbrella frame which is simple to manufacture and can be easily assembled.

It is yet another object of the present invention to provide an umbrella frame which is compact, lightweight, has good mechanical strength and long-life.

It is yet another object of the present invention to provide an umbrella frame which can be used for small, medium and large sized umbrellas.

BRIEF DESCRIPTION OF THE DRAWINGS

For a better understanding of the present invention and to show more clearly how it may be carried into effect, reference will now be made, by way of example, to the accompanying drawings which show, by way of example, the present invention and in which.

DETAILED DESCRIPTION

Figure 1:
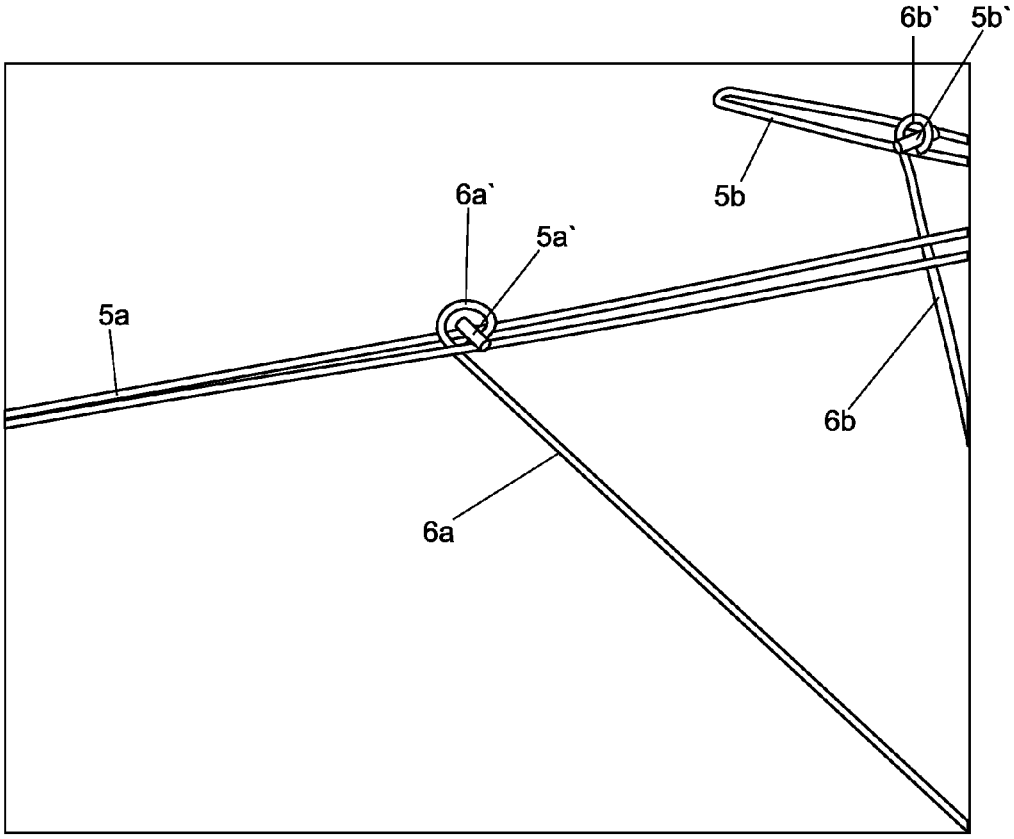
FIG. 1 is a fragmentary side view of the two arms and spacers attached thereon.

The following description and drawings are illustrative and are not to be construed as limiting. Numerous specific details are described to provide a thorough understanding. However, in certain instances, well known or conventional details are not described in order to avoid obscuring the description. References to one or another embodiment in the present disclosure are not necessarily references to the same embodiment.

Reference in this specification to "one embodiment" or "an embodiment" or the like means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not other embodiments.

The present invention is directed to an umbrella, and more particularly to an umbrella frame assembly. While this invention is susceptible of embodiment in many different forms, there is shown in the drawings and will herein be described in detail at least one specific embodiment, with the understanding that the present disclosure is to be considered as an exemplification of the principles of the invention and is not intended to limit the invention to the embodiment or embodiments illustrated.

With reference to FIGS. 1-18, an umbrella frame assembly 10 is illustrated. As shown in FIG. 2A the umbrella frame 10 comprises of a post 20 having a top end 20*a* and a bottom end 20*b*. As illustrated the post 20 is made up of four wires 2*a*, 2*b*, 2*c* and 2*d*. The wires 2*a* and 2*b* are made of a single half-bent wire 2*ab* whereas the wires 2*c* and 2*d* are made up of another half-bent wire 2*cd*.

In an embodiment of the invention the four wires 2*a*, 2*b*, 2*c* and 2*d* can be separate independent wires.

In another embodiment of the invention, the post 20 can be made up of any number of wires.

In yet another embodiment of the invention, the post 20 can be a tubular shaped body.

The wires 2*a*, 2*b*, 2*c* and 2*d* are bound to each other by four spacers 3*a*, 3*b*, 3*c* and 3*d* located near the top end 20*a* of the post 20. The spacers 3*a*, 3*b*, 3*c* and 3*d* provide strength and alignment to the wires 2*a*, 2*b*, 2*c* and 2*d*. The spacers 3*a*, 3*b*, 3*c* and 3*d* also function to provide resistance against bending to the post 20 and improve the mechanical stability of the umbrella frame 10.

In yet another embodiment of the invention, any numbers of spacers are used to bind the wires 2*a*, 2*b*, 2*c* and 2*d*.

The spacers 3*a*, 3*b*, 3*c* and 3*d* must be provided along the wires 2*a*, 2*b*, 2*c* and 2*d* for the reason that if the spacers are too far apart then the wires 2*a*, 2*b*, 2*c* and 2*d* will act as separate units and not as one integrated unit joined to each other and this will result in decrease in the overall strength of the post 20.

Figure 10A:
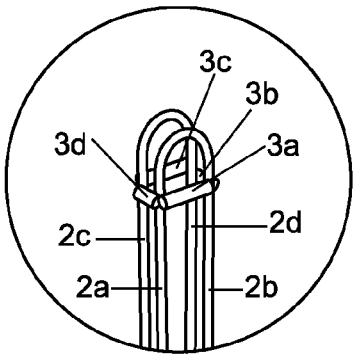
FIG. 10A-10P shows various modifications in the post and the arrangement of the spacers near its top end.
Figure 10B:
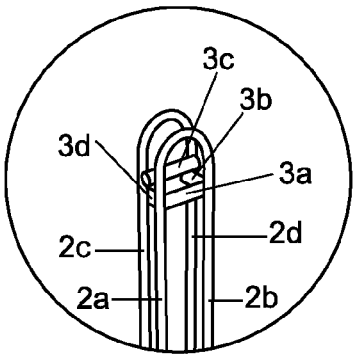
Figure 10C:
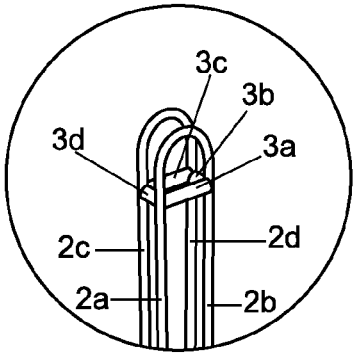
Figure 10D:
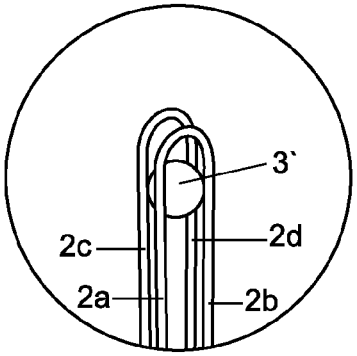
Figure 10E:
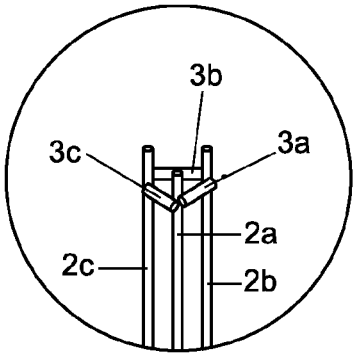
Figure 10F:
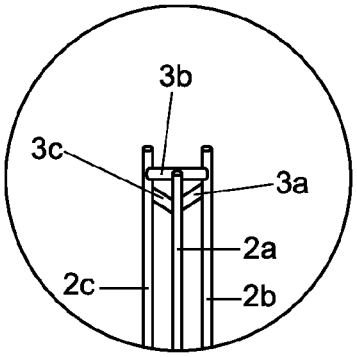
Figure 10G:
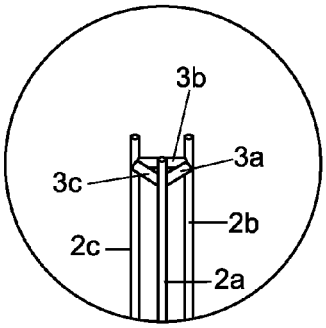
Figure 10H:
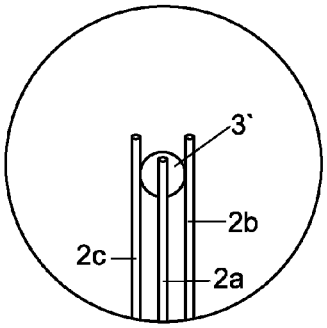
Figure 10I:
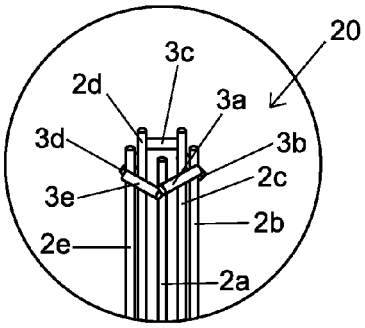
Figure 10J:
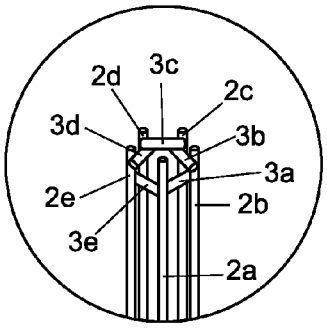
Figure 10K:
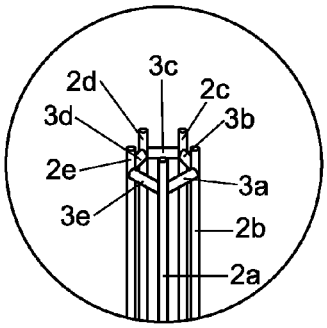
Figure 10L:
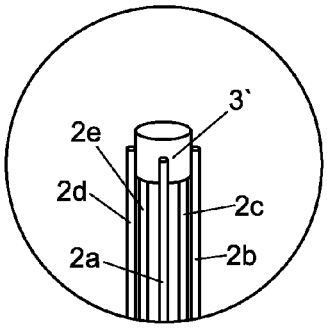
Figure 10M:
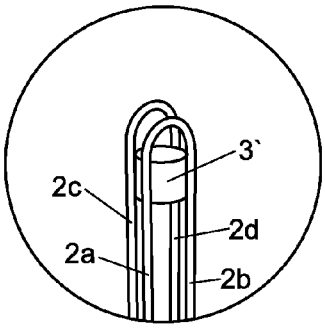
Figure 10N:
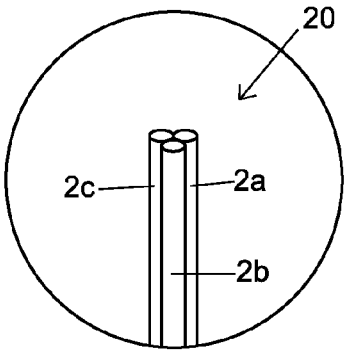
Figure 10O:
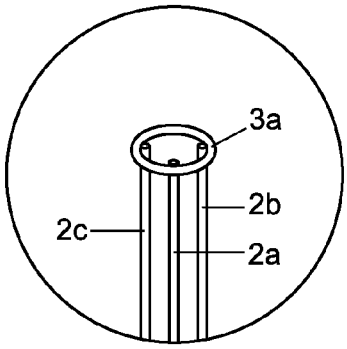
Figure 10P:
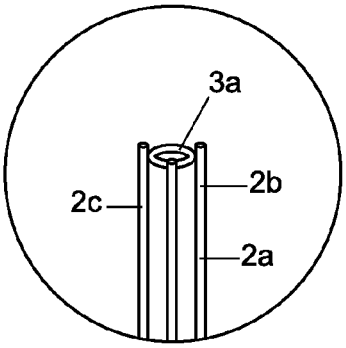

As shown in FIGS. 10A to 10P, there are different configurations possible for the uppermost spacers 3*a*, 3*b*, 3*c* and 3*d* or intermediate spacers along the post 20 (not shown) while fixing them on the wires 2*a*, 2*b*, 2*c* and 2*d*. The spacers 3*a*, 3*b*, 3*c* and 3*d* can be located inside, outside and/or in-between the wires 2*a*, 2*b*, 2*c* and 2*d*.

In yet another embodiment of the invention, the spacers 3*a*, 3*b*, 3*c* and 3*d* as shown in FIG. 2A may be welded to the wires 2*a*, 2*b*, 2*c* and 2*d* or affixed by any other mechanism such as use of adhesives etc.

The umbrella frame 10 further comprises of a movable lift ring 4 mounted circumferentially around the post 20. Four arms 5*a*, 5*b*, 5*c* and 5*d* are coupled to the post 20 proximally at its top end 20*a*. The arm 5*a* is made up of two wires 5*aa* and 5*ab* wherein the wires 5*aa* and 5*ab* are made from a single half-bent wire. Similarly the arms 5*b*, 5*c* and 5*d* comprises of two wires 5*ba*, 5*bb*; 5*ca*, 5*cb*; 5*da*, 5*db* each as shown in FIG. 2A.

In yet another embodiment of the invention, the arms 5*a*, 5*b*, 5*c* and 5*d* can be made up of any number of wires.

Figure 15A:
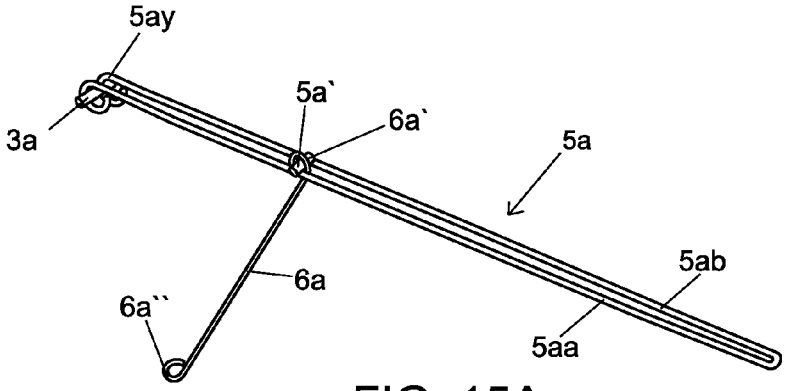
FIG. 15A-15C shows different ways of connecting the modular connector and the arm.
Figure 15B:
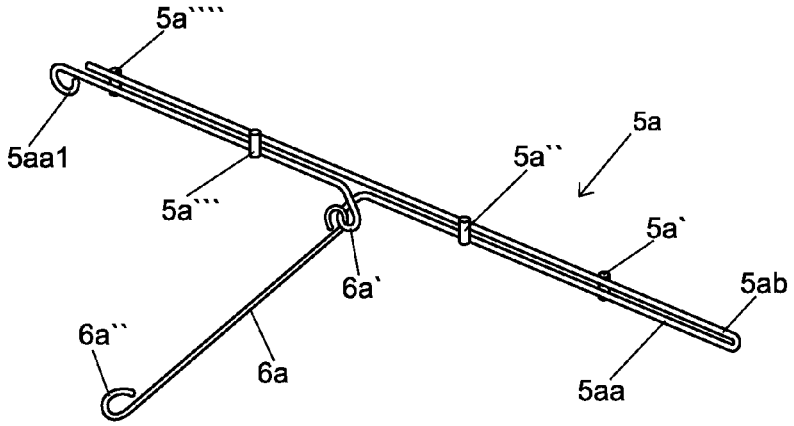
Figure 15C:
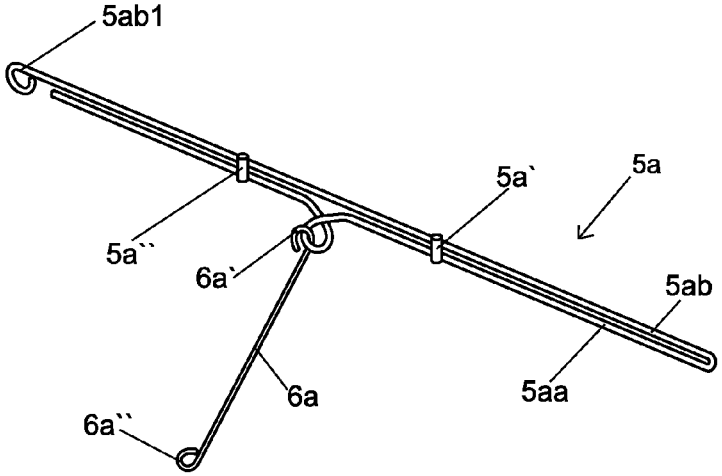

In yet another embodiment of the invention, the plurality of wires of each arm 5*a*, 5*b*, 5*c* and 5*d* may be merged as shown in FIG. 15B and FIG. 15C into a single wire towards the end to be connected to the post 20.

One end 5*ax*, 5*bx*, 5*cx* and 5*dx* of each of the arms 5*a*, 5*b*, 5*c* and 5*d* is curved due to the half-bent wire configuration of the arms 5*a*, 5*b*, 5*c* and 5*d* while the other ends 5*ay*, 5*by*, 5*cy* and 5*dy* wherein the end 5*ay* comprises of the wires 5*aa* and 5*ab* bent as a pair in the form of a hook and similarly the ends 5*by*, 5*cy* and 5*dy* comprises of wires 5*ba*, 5*bb*; 5*ca*, 5*cb*; 5*da*, 5*db* being bent in pairs in hook shape and connected to the spacers 3*a*, 3*b*, 3*c* and 3*d* respectively. This hook type attachment of the ends 5*ay*, 5*by*, 5*cy* and 5*dy* permits free rotation of the arms 5*a*, 5*b*, 5*c* and 5*d* relative to the spacers 3*a*, 3*b*, 3*c* and 3*d* respectively.

In yet another embodiment of the invention, the ends 5*ay*, 5*by*, 5*cy* and 5*dy* of the arms 5*a*, 5*b*, 5*c* and 5*d* to be connected to the spacers 3*a*, 3*b*, 3*c* and 3*d* can be a single closed loop.

Four spacers 5*a*', 5*b*', 5*c*' and 5*d*' are mounted intermediately on the arms 5*a*, 5*b*, 5*c* and 5*d*. The spacers 5*a*', 5*b*', 5*c*' and 5*d*' provide mechanical strength and rigidity to the arms 5*a*, 5*b*, 5*c* and 5*d* of the umbrella frame 10. The umbrella frame 10 also includes four modular connectors 6*a*, 6*b*, 6*c* and 6*d*. Each of modular connector 6*a*, 6*b*, 6*c* and 6*d* has a first end 6*a*', 6*b*', 6*c*' and 6*d*' and a second end 6*a*", 6*b*", 6*c*" and 6*d*". The modular connector 6*a* has its first end 6*a*' connected to the spacer 5*a*' and its second end 6*a*' connected to the lift ring 4. Similarly the modular connectors 6*b*, 6*c* and 6*d* have their first ends 6*b*', 6*c*' and 6*d*' connected to the spacers 5*b*', 5*c*' and 5*d*' and second end 6*b*", 6*c*" and 6*d*" connected to the lift ring 4 as depicted in FIG. 2A. The movable lift ring 4 facilitates the opening and closing of the arms 5*a*, 5*b*, 5*c* and 5*d* by moving freely along the post 20.

In yet another embodiment of the invention, the first ends 6*a*', 6*b*', 6*c*' and 6*d*' and the second ends 6*a*", 6*b*", 6*c*" and 6*d*" of the modular connectors 6*a*, 6*b*, 6*c* and 6*d* are in the form of a closed hook to get easily connected to the lift ring 4 and the spacers 5*a*', 5*b*', 5*c*' and 5*d*'.

In yet another embodiment of the invention, the first ends 6*a*', 6*b*', 6*c*' and 6*d*' of the modular connectors 6*a*, 6*b*, 6*c* and 6*d* can be connected directly to the wires 5*aa*, 5*ab*; 5*ba*, 5*bb*; 5*ca*, 5*cb*; 5*da* and 5*db* of the arms 5*a*, 5*b*, 5*c* and 5*d*.

Figure 2A:
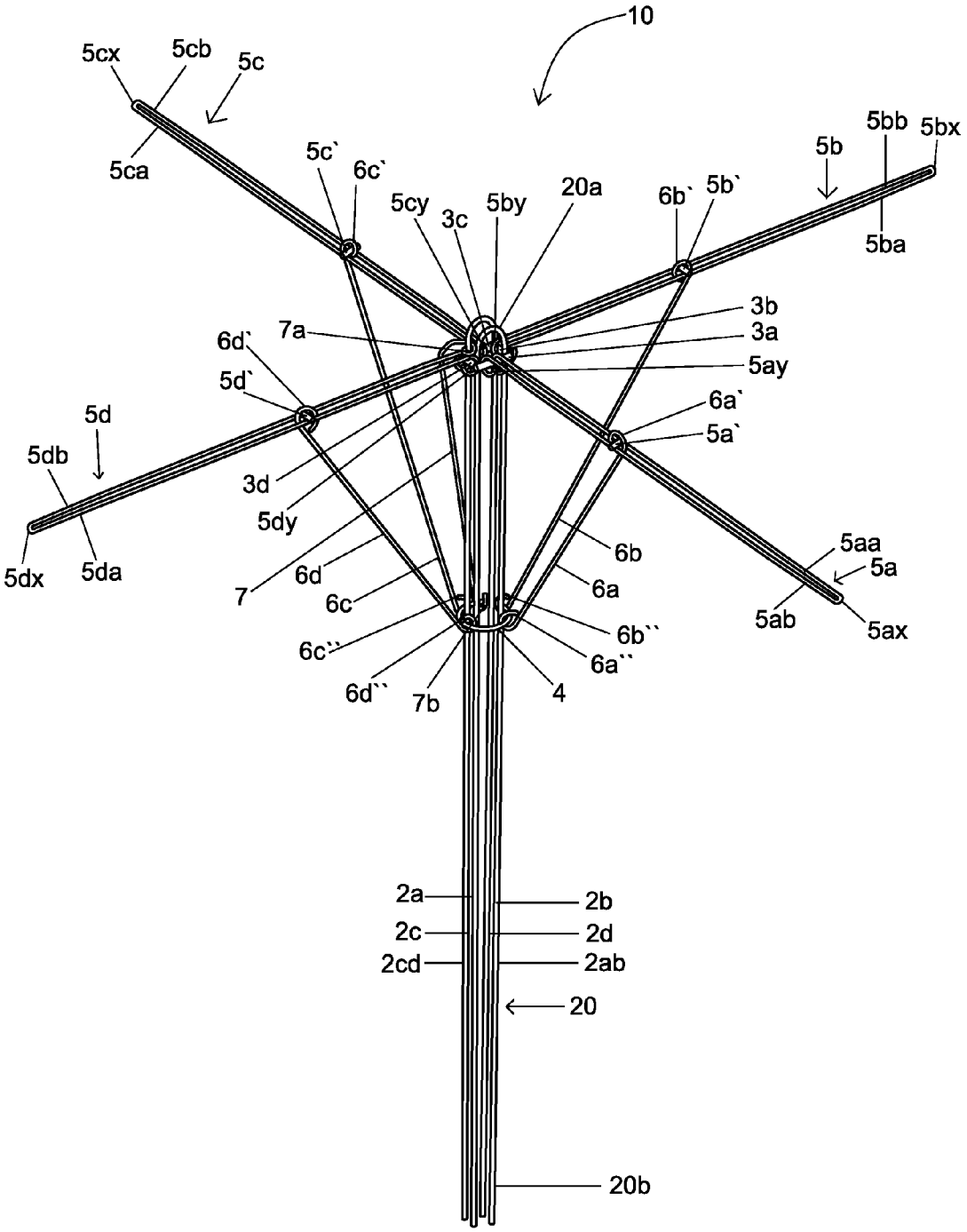
FIG. 2A illustrates a preferred embodiment of umbrella frame according to the invention where the umbrella frame is open.

FIG. 1 shows two modular connectors 6*a* and 6*b* with their first ends 6*a*' and 6*b*' being connected to the spacer 5*a*' and 5*b*' of the arms 5*a* and 5*b*.

Figure 7:
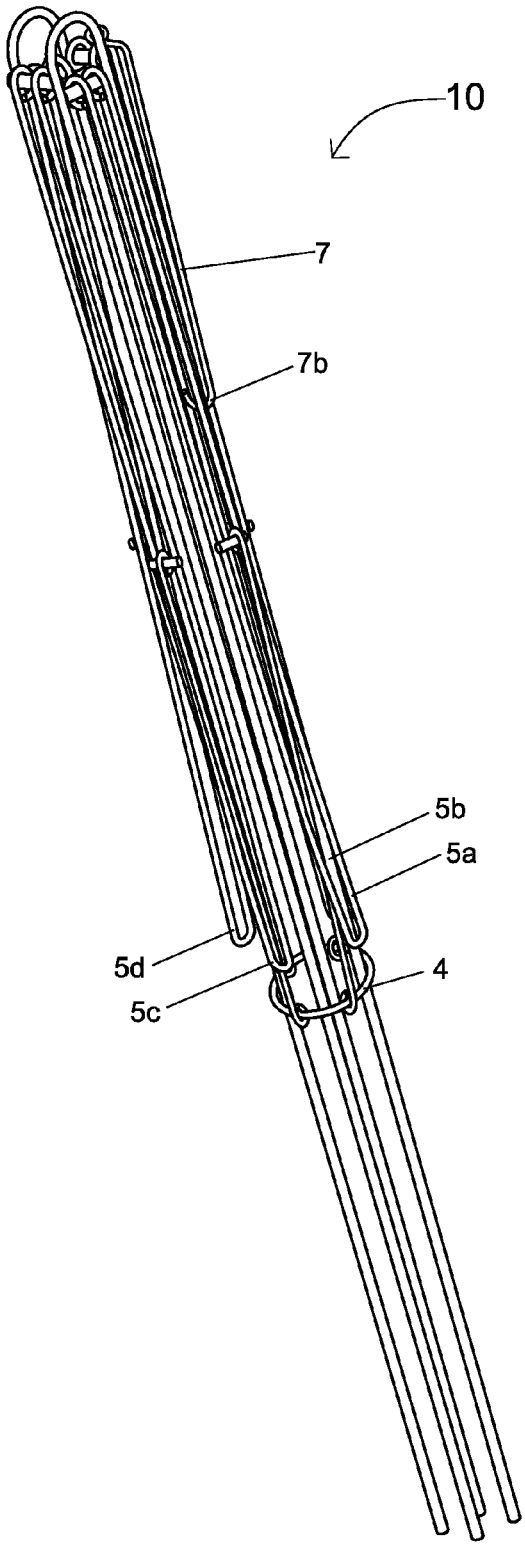
FIG. 7 is a fragmentary side view of the umbrella of the invention being folded.

A locking element 7 is shown in FIG. 2A having two ends 7*a* and 7*b* with the first end 7*a* being hooked to the post 20 near its top end 20*a* and the second end 7*b* hooked to the lift ring 4. The locking element 7 engages the post 20 and the lift ring 4 and functions to keep the arms 5*a*, 5*b*, 5*c* and 5*d* in the open position. When the umbrella frame 10 is to be closed as shown in FIG. 7, the second end 7*b* of the locking element 7 can be released from the lift ring 4 and the lift ring 4 can be moved downwards to bring the arms 5*a*, 5*b*, 5*c* and 5*d* in a closed configuration.

In yet another embodiment of the invention, the locking element 7 can be a press-button type mechanism to facilitate easy opening/closing of the umbrella frame 10.

In yet another embodiment of the invention, a fabric cover is affixed to the arms 5*a*, 5*b*, 5*c* and 5*d*. The cover provides shade and protection for the umbrella user or the garden plant.

In yet another embodiment of the invention, the fabric cover is made of any suitable material.

Figure 13A:
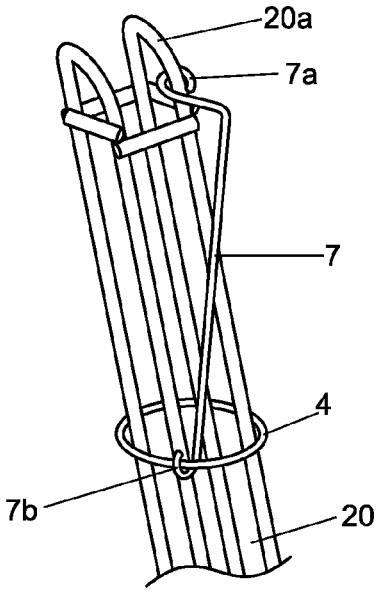
FIG. 13A shows a locking element engaging the post and the lift ring.
Figure 13B:
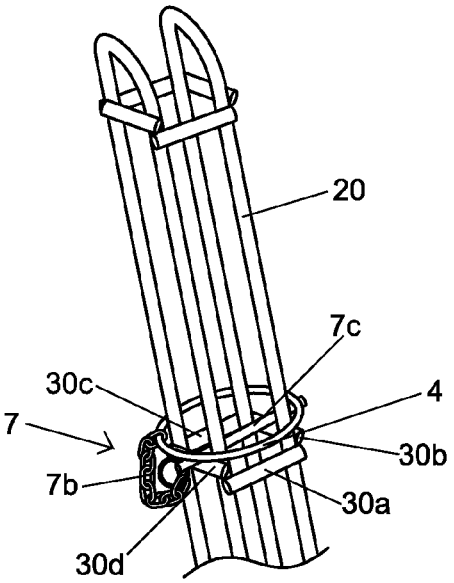
FIG. 13B is a view similar to FIG. 13A, where a locking element is mounted on the lift ring.

With reference to FIG. 13A and FIG. 13B, two variations of the locking element 7 are depicted. As shown in FIG. 13A the locking element 7 with two ends 7*a* and 7*b* is shown. The first end 7*a* is hooked to the post 20 near its top end 20*a* and the second end 7*b* is hooked to the lift ring 4.

In yet another embodiment of the invention, as shown in FIG. 13B, the locking element 7 is in the form of a chain-pin assembly connected to the lift ring 4. The locking element comprises of a chain 7*b* and a pin 7*c*. Four spacers 30*a*, 30*b*, 30*c* and 30*d* are fixed on the post 20. When the locking element is to be engaged the pin is driven through the post 20 and rests along the spacers 30*a*, 30*b*, 30*c* and 30*d*.

Figure 12A:
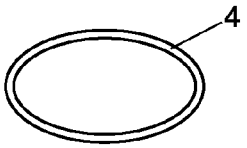
FIG. 12A-12D illustrates the various shapes of the lift ring.

In yet another embodiment of the invention, the lift ring 4 is a circular ring as shown in FIG. 12A. The lift ring 4 moves freely along the post 20 and performs the function of an element responsible for opening and closing of the umbrella frame 10.

Figure 12B:
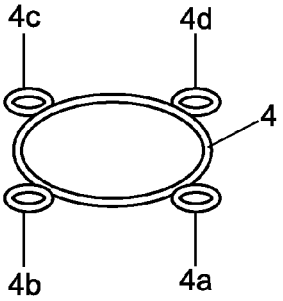

In yet another embodiment of the invention, as shown in FIG. 12B the lift ring 4 can have four loops 4*a*, 4*b*, 4*c* and 4*d* located outside along its periphery.

Figure 12C:
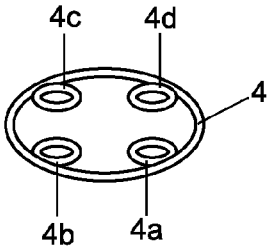

In yet another embodiment of the invention, as shown in FIG. 12C the loops 4*a*, 4*b*, 4*c* and 4*d* can be located inside the circumference of the lift ring 4.

Figure 12D:
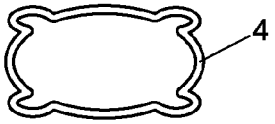

In yet another embodiment of the invention, the lift ring 4 can have bumps along its circumference as shown in FIG. 12D.

In yet another embodiment of the invention, the lift ring 4 can have any other geometric shape suitable for working on the umbrella frame 10. The lift ring 4 may also comprise of a push-button mechanism to hook/unhook the lift ring 4 from the locking element 7.

Figure 2B:
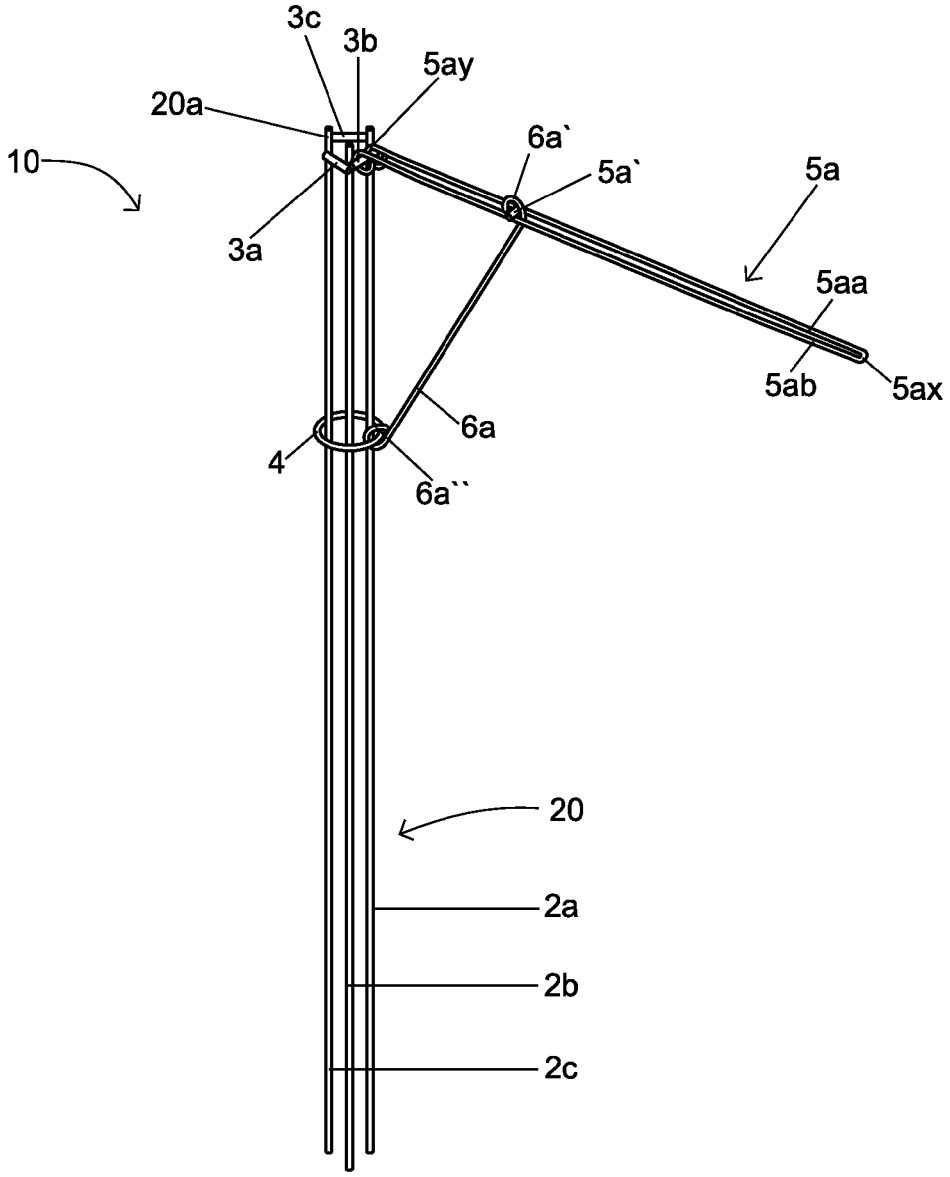
FIG. 2B and FIG. 2C are a perspective view of the post and a single arm connected to each other via a modular connector.

With reference to FIG. 2B, three independent wires 2*a*, 2*b* and 2*c* are shown which make up the post 20 of the umbrella frame 10. Spacers 3*a*, 3*b* and 3*c* are provided in an outside configuration near the top end 20*a* of the post 20. The lift ring 4 is mounted circumferentially along the post 20. One arm 5*a* which comprises of half-bent wires 5*aa* and 5*ab* has one of its end 5*ax* made in a curved shape and the other end 5*ay* hooked to the spacer 3*b*. The arm 5*a* also comprises of a spacer 5*a*'. A modular connector 6*a* having a first end 6*a*' and a second end 6*a*" is also incorporated in the umbrella frame assembly 10. The first end 6*a*' of the modular connector 6*a* is hooked to the spacer 5*a*' and the second end 6*a*" is hooked to the lift ring 4.

Figure 2C:
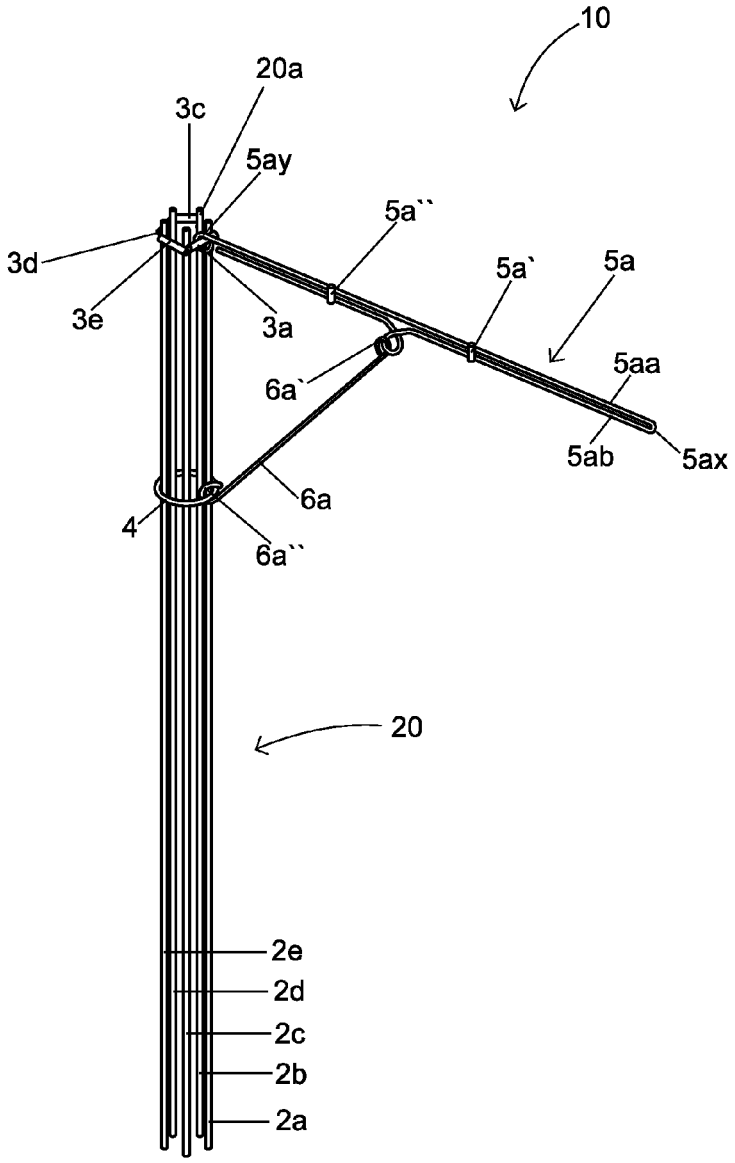

FIG. 2C shows another embodiment of the invention in which the post 20 comprises of five wires 2*a*, 2*b*, 2*c*, 2*d* and 2*e*. The wires are bounded to each other with the help of five spacers 3*a*, 3*b* (not shown), 3*c*, 3*d* and 3*e* located near the top end 20*a* of the post 20. The spacers 3*a*, 3*b* (not shown), 3*c*, 3*d* and 3*e* give mechanical strength to the post 20 and provide resistance against the bending of the post 20 under external forces. The spacers 3*a*, 3*b* (not shown), 3*c*, 3*d* and 3*e* are placed in an outside configuration with respect to the wires 2*a*, 2*b*, 2*c*, 2*d* and 2*e*. The lift ring 4 is mounted circumferentially along the post 20. One arm 5*a* which comprises of half-bent wires 5*aa* and 5*ab* and has a first curved end 5*ax* and second end 5*ay* which is hooked to the spacer 3*a*. The wires 5*aa* and 5*ab* lie in a vertical plane with respect to each other. The arm 5*a* also comprises of two spacers 5*a*' and 5*a*" rigidly fixed to it. A modular connector 6*a* having a first end 6*a*' and a second end 6*a*" is also incorporated in the umbrella frame assembly 10. The first end 6*a*' of the modular connector 6*a* is hooked to a loop formed in the wire 5*aa* of the arm 5*a* and the second end 6*a*" is hooked to the lift ring 4.

Figure 3:
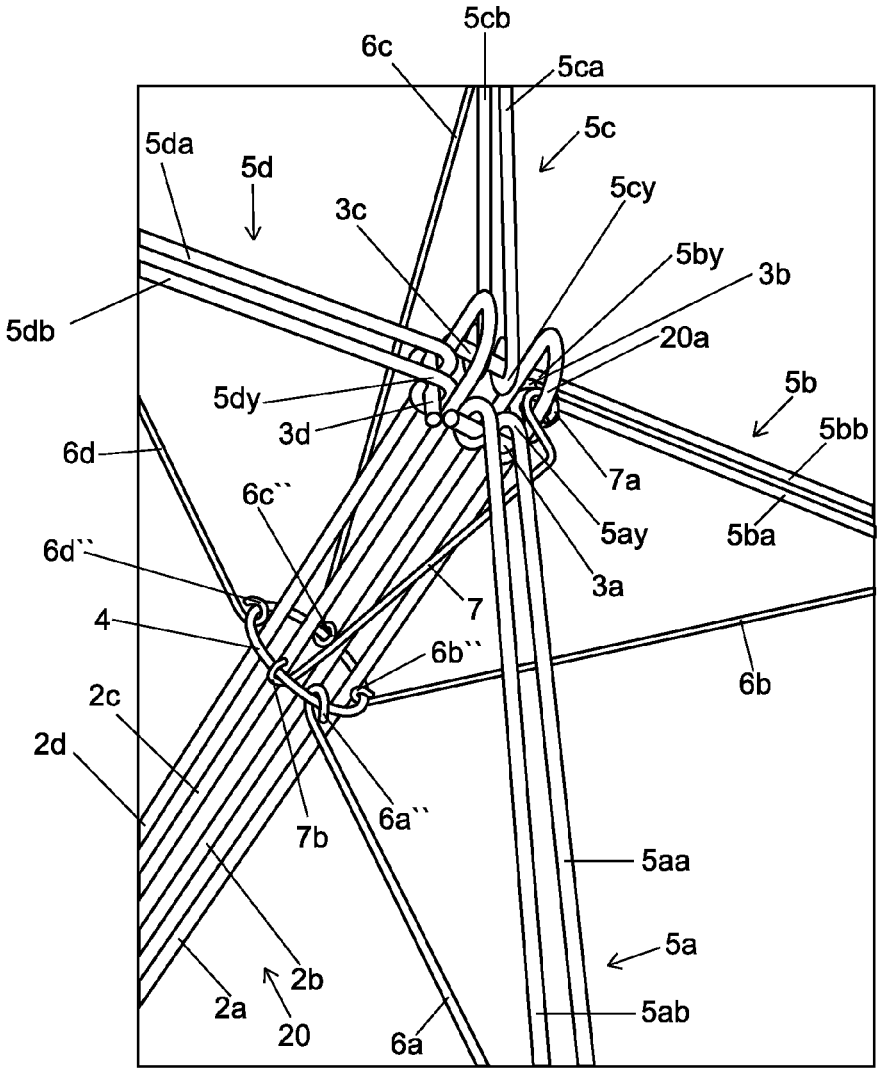
FIG. 3 illustrates the various connections of the modular connector and the locking element to the lift ring and the arms.

FIG. 3 is a perspective view showing four arms 5*a*, 5*b*, 5*c* and 5*d* coupled to the post 20 proximally at its top end 20*a* wherein the post 20 comprises of four wires 2*a*, 2*b*, 2*c* and 2*d*. The arm 5*a* is made up of two wires 5*aa* and 5*ab*; similarly the arms 5*b*, 5*c* and 5*d* comprises of two wires 5*ba*, 5*bb*; 5*ca*, 5*cb* and 5*da*, 5*db* each. A lift ring 4 is mounted circumferentially around the post 20. The respective ends 5*ay*, 5*by*, 5*cy* and 5*dy* of the arms 5*a*, 5*b*, 5*c* and 5*d* are hooked to the spacers 3*a*, 3*b*, 3*c* and 3*d* placed wherein the end 5*ay* comprises of the pair of wires 5*aa* and 5*ab* being bent in hook shape and similarly the ends 5*by*, 5*cy* and 5*dy* comprises of pair of wires 5*ba*, 5*bb*; 5*ca*, 5*cb* and 5*da*, 5*db* bent in hook configuration as shown in FIG. 3. A locking element 7 having two ends 7*a* and 7*b* is also depicted with the first end 7*a* being hooked near the top end 20*a* of the post 20 and the second end 7*b* connected to the lift ring 4. The spacers 3*a*, 3*b*, 3*c* and 3*d* act as an obstacle for the first end 7*a* of the locking element 7 and prevent it from sliding downwards. The configuration in which the ends 7*a* and 7*b* of the locking element 7 are hooked to the post 20 and the lift ring 4 resembles the state when the arms 5*a*, 5*b*, 5*c* and 5*d* are in open position. The modular connectors 6*a*, 6*b*, 6*c* and 6*d* have their second ends 6*a*", 6*b*", 6*c*" and 6*d*" connected to the lift ring 4 as depicted in FIG. 3.

Figure 4:
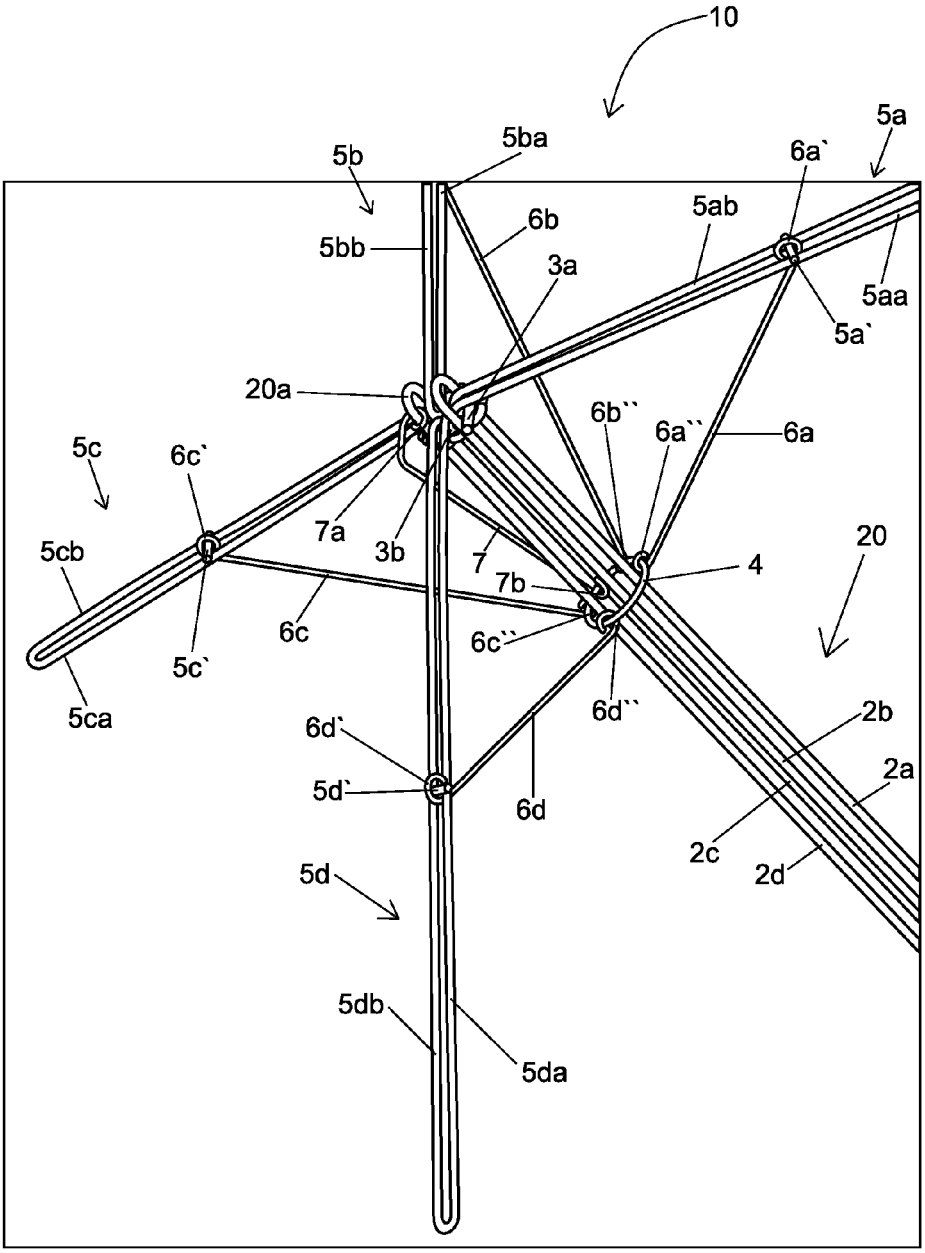
FIG. 4 is a top side view of the umbrella frame showing the post, arms, modular connectors, locking element and the lift ring.

FIG. 4 shows another perspective view of the umbrella frame 10 with the post 20 having a top end 20*a* to which four spacers 3*a*, 3*b*, 3*c* (not shown) and 3*d* (not shown) are attached. The post 20 comprises of half-bent wires 2*a*, 2*b*, 2*c* and 2*d* respectively. A lift ring 4 is mounted circumferentially around the post 20 and has an end 7*b* of the locking element 7 hooked to it while the other end 7*a* is hooked to the post 20 near its top end 20*a*. Four arms 5*a*, 5*b*, 5*c* and 5*d* wherein the arm 5*a* is made up of two wires 5*aa* and 5*ab*, arm 5*b* is made up of two wires 5*ba* and 5*bb*, arm 5*c* is made up of two wires 5*ca* and 5*cb* and arm 5*d* is made up of two wires 5*da* and 5*db*. All the wires 5*aa*, 5*ab*; 5*ba*, 5*bb*; 5*ca*, 5*cb*; 5*da*, 5*db* of the four arms 5*a*, 5*b*, 5*c* and 5*d* are in half-bent configuration and lie in a horizontal plane with respect to each other.

In yet another embodiment of the invention, the wires 5*aa*, 5*ab*; 5*ba*, 5*bb*; 5*ca*, 5*cb*; 5*da*, 5*db* can be independent single wires.

As shown in FIG. 4, four spacers 5*a*', 5*b*' (not shown), 5*c*' and 5*d*' ' are affixed to the arms 5*a*, 5*b*, 5*c* and 5*d* and the first ends 6*a*', 6*b*' (not shown), 6*c*' and 6*d*' of the modular connectors 6*a*, 6*b*, 6*c* and 6*d* are connected to the spacers 5*a*', 5*b*' (not shown), 5*c*' and 5*d*' while the other ends 6*a*", 6*b*", 6*c*" and 6*d*" are connected to the lift ring 4.

Figure 5:
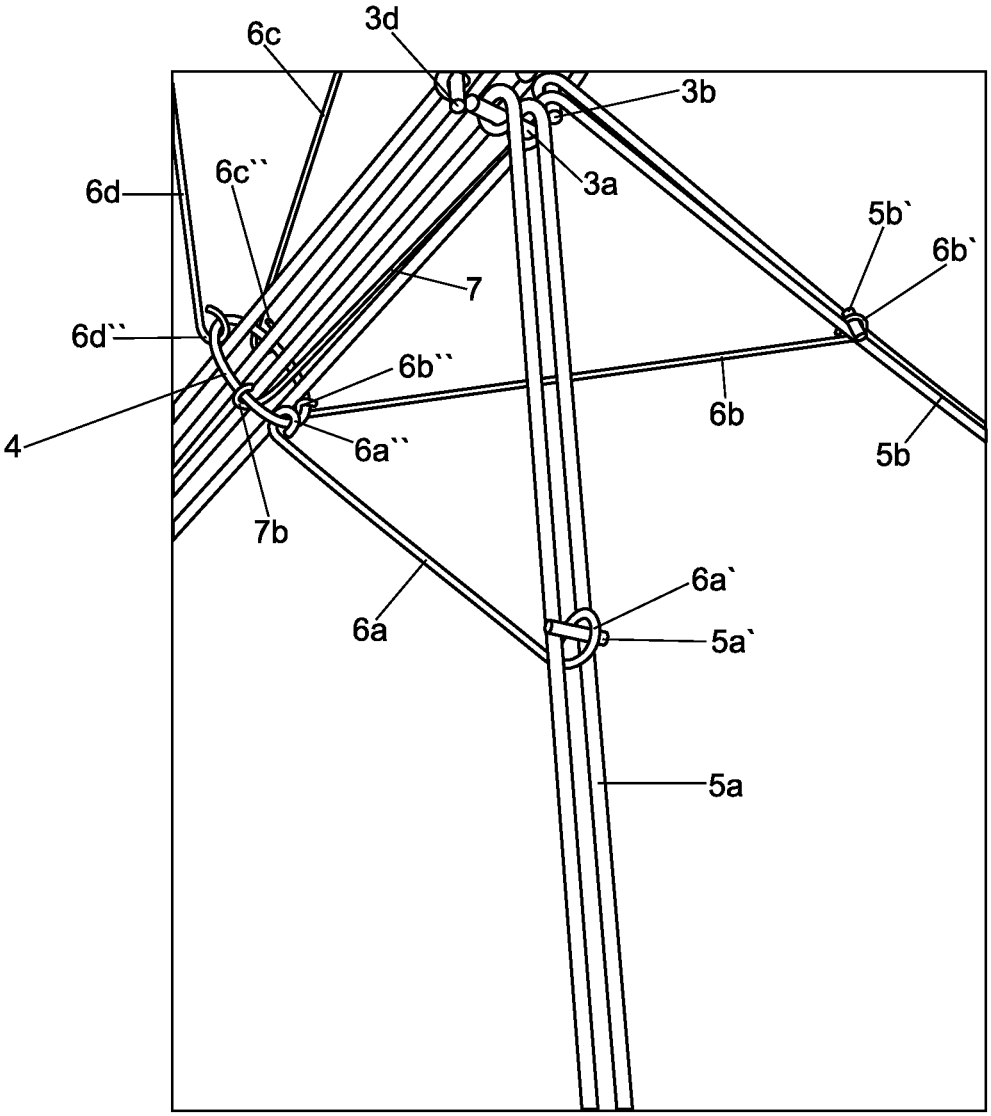
FIG. 5 is a side elevation of the umbrella frame of the invention showing the modular connectors being connected to the arms and the lift ring.

FIG. 5 illustrates the mechanism of hooking the first ends 6*a*' and 6*b*' of the modular connectors 6*a* and 6*b* to the spacers 5*a*' and 5*b*' of the arms 5*a* and 5*b*. Similarly the first ends 6*c*' (not shown) and 6*d*' (not shown) of the modular connectors 6*c* and 6*d* are connected to the spacers 5*c*' (not shown) and 5*d*' (not shown) of the arms 5*c* (not shown) and 5*d* (not shown). The lift ring 4 has the second ends 6*a*", 6*b*", 6*c*" and 6*d*" of the modular connectors 6*a*, 6*b*, 6*c* and 6*d* coupled to it. The locking element 7 has its second end 7*b* being hooked to the lift ring 4. The arms 5*a*, 5*b*, 5*c* (not shown) and 5*d* (not shown) are hooked to the spacers 3*a*, 3*b*, 3*c* (not shown) and 3*d* to be coupled to the post 20.

Figure 6:
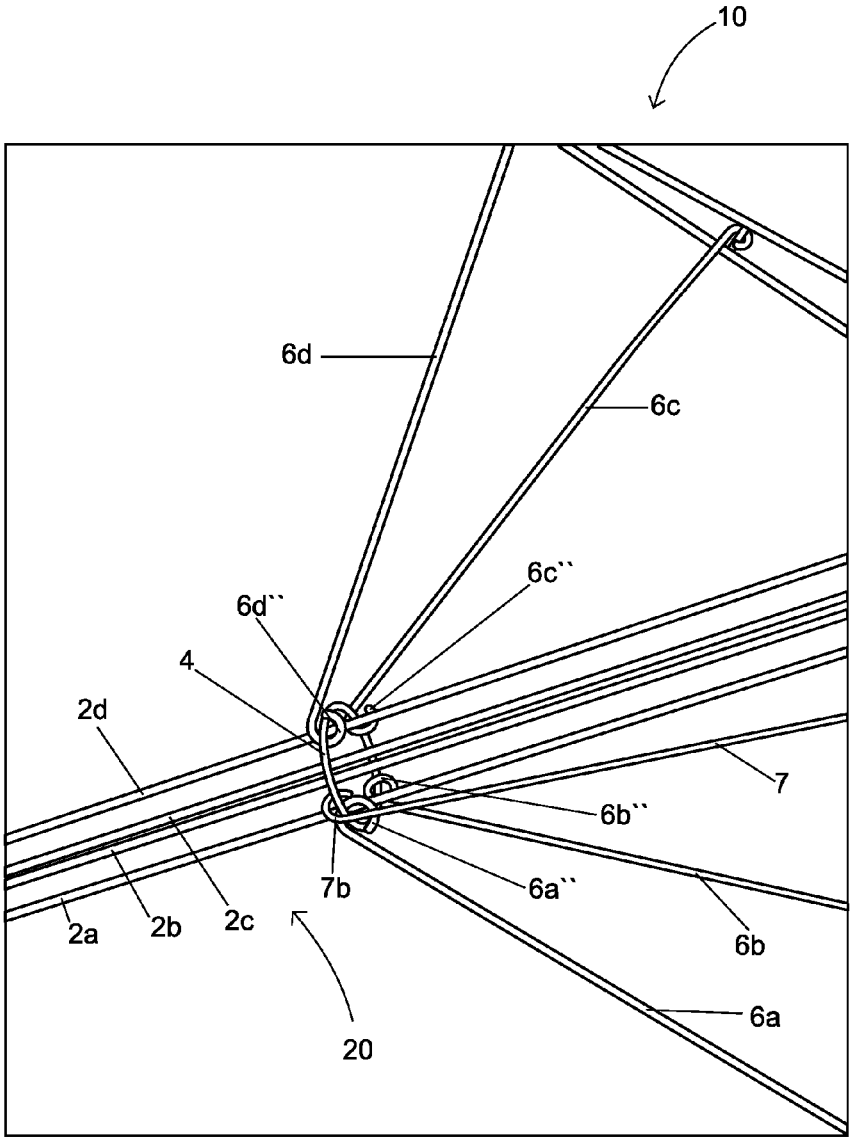
FIG. 6 illustrates the modular connectors being attached to the lift ring.
Figure 8:
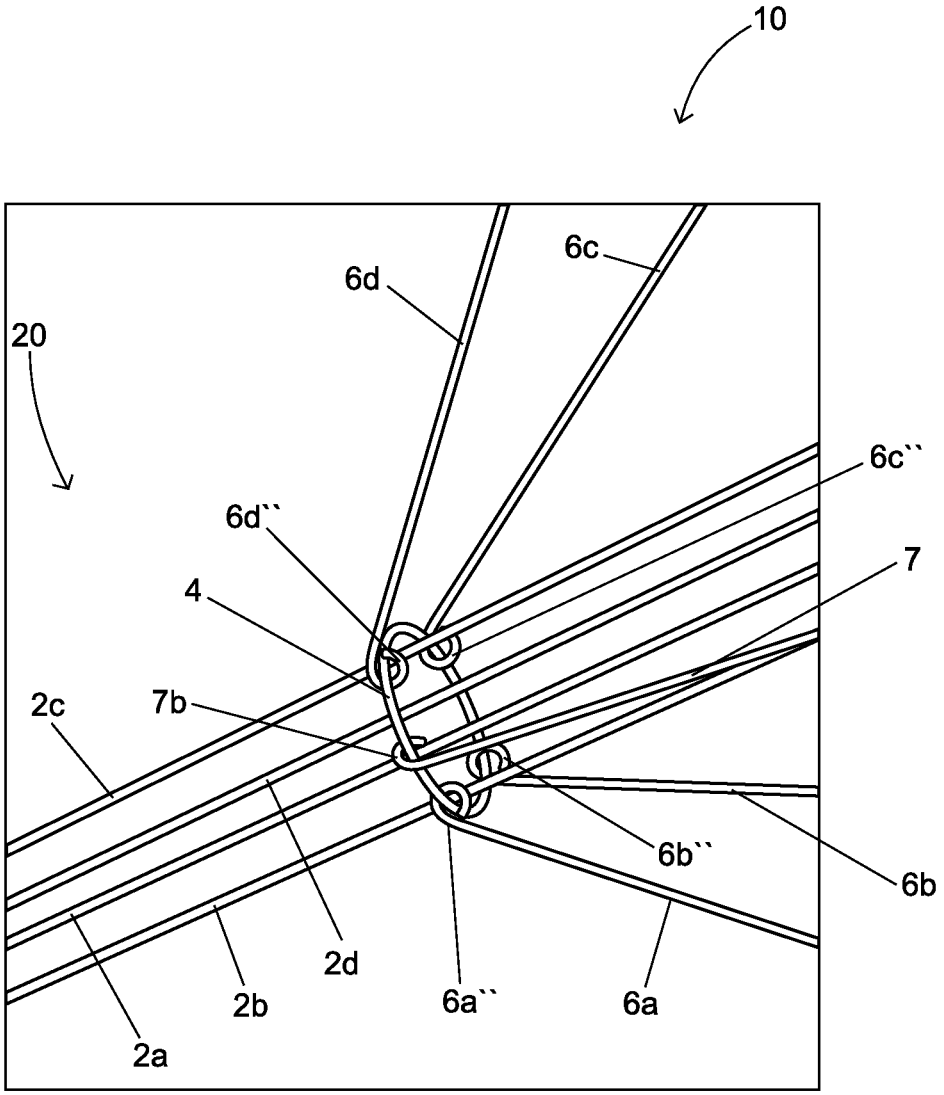
FIG. 8 illustrates the second ends of the modular connectors and the locking element being attached to the lift ring.

FIG. 6 and FIG. 8 shows an arrangement of the four wires 2*a*, 2*b*, 2*c* and 2*d* of the post 20 and the lift ring 4 held along the post 20 with the second ends 6*a*", 6*b*", 6*c*" and 6*d*" of the modular connectors 6*a*, 6*b*, 6*c* and 6*d* coupled to it. The second end 7*b* of the locking element 7 is hooked to the lift ring 4. As can be clearly seen in FIG. 6 and FIG. 8, the second ends 6*a*", 6*b*", 6*c*" and 6*d*" of the modular connectors 6*a*, 6*b*, 6*c* and 6*d* are shaped in the form of a hook for the purpose of being rigidly fixed to the lift ring 4 and serves to provide better strength and mechanical stability to the umbrella frame 10.

In yet another embodiment of the invention, the second ends 6*a*", 6*b*", 6*c*" and 6*d*" of the modular connectors 6*a*, 6*b*, 6*c* and 6*d* can have any other shape which serves the purpose of getting rigidly fixed to the lift ring 4.

In yet another embodiment of the invention, the lift ring 4 may comprise of locking members to hold the second ends 6*a*", 6*b*", 6*c*" and 6*d*" of the modular connectors 6*a*, 6*b*, 6*c* and 6*d*.

Figure 9:
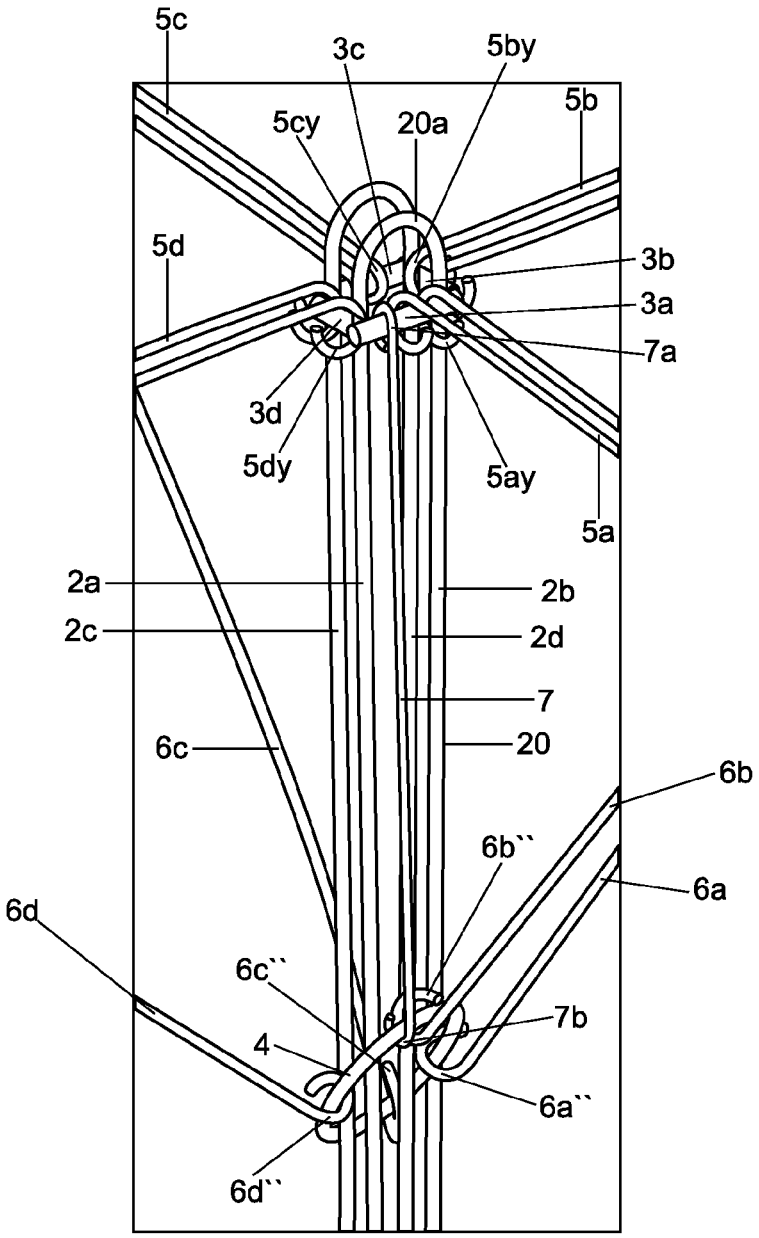
FIG. 9 shows the post, arms, lift ring, locking element and the second ends of the modular connectors being hooked to the lift ring.

FIG. 9 illustrates the four wires 2*a*, 2*b*, 2*c* and 2*d* of the post 20 wherein the wires 2*a*, 2*b*, 2*c* and 2*d* are made from two single wires by bending them into two sections. At the top end 20*a* of the post 20 spacers 3*a*, 3*b*, 3*c* and 3*d* are attached in an outside configuration to the wires 2*a*, 2*b*, 2*c* and 2*d*. The ends 5*ay*, 5*by*, 5*cy* and 5*dy* of the arms 5*a*, 5*b*, 5*c* and 5*d* are hooked to the spacers 3*a*, 3*b*, 3*c* and 3*d*.

In yet another embodiment of the invention, the ends 5*ay*, 5*by*, 5*cy* and 5*dy* of the arms 5*a*, 5*b*, 5*c* and 5*d* can also be welded to the spacers 3*a*, 3*b*, 3*c* and 3*d*.

As shown in FIG. 9, a lift ring 4 is mounted circumferentially around the post 20 and the second ends 6*a*", 6*b*", 6*c*" and 6*d*" of the modular connectors 6*a*, 6*b*, 6*c* and 6*d* are connected to the lift ring 4. A locking element 7 having two ends 7*a* and 7*b* is used for the purpose of engaging the lift ring 4 and the post 20 to keep the arms 5*a*, 5*b*, 5*c* and 5*d* in the open position. The first end 7*a* of the locking element 7 is attached to the spacer 3*a* while the other end 7*b* is attached to the lift ring 4.

The first end 7*a* of the locking element 7 can have two different positions of attachment, firstly it can be connected directly to the top end 20*a* of the post 20 and secondly it can be attached to the spacer 3*a* lying near the top end 20*a* of the post 20 as shown in FIG. 9.

In yet another embodiment of the invention, the first end 7*a* of the locking element 7 can be attached to any one of the spacers 3*a*, 3*b*, 3*c* and 3*d*.

In yet another embodiment of the invention, the locking element 7 may comprise of a plurality of wires.

Further, as can be seen in FIG. 9 the lift ring 4 is in tilted orientation, this is due to the load exerted on the lift ring 4 by the arms 5*a*, 5*b*, 5*c* and 5*d* when they are in the open position.

In yet another embodiment of the invention, the lift ring 4 can be a double ring to make it stronger.

FIG. 10A-10P shows the various possible configurations of the spacers 3*a*, 3*b*, 3*c* and 3*d* to be fixed to the wires 2*a*, 2*b*, 2*c* and 2*d*. As shown in FIG. 10A, the four spacers 3*a*, 3*b*, 3*c* and 3*d* are located in an outside configuration on the wires 2*a*, 2*b*, 2*c* and 2*d*. FIG. 10B illustrates the second possible configuration in which the spacers 3*a*, 3*b*, 3*c* and 3*d* are located inside the wires 2*a*, 2*b*, 2*c* and 2*d*. The third configuration of the spacers 3*a*, 3*b*, 3*c* and 3*d* being placed in-between the wires 2*a*, 2*b*, 2*c* and 2*d* is illustrated in FIG. 10C.

In yet another embodiment of the invention, as shown in FIG. 10D a ball bearing 3' acts as a spacer joining the wires 2*a*, 2*b*, 2*c* and 2*d* together.

In yet another embodiment of the invention, as depicted in FIG. 10E three spacers 3*a*, 3*b* and 3*c* binds three independent wires 2*a*, 2*b* and 2*c* together for providing mechanical stability and strength. The spacers in FIG. 10E are placed outside the three wires 2*a*, 2*b*, and 2*c*. The arrangement of the spacers 3*a*, 3*b*, and 3*c* inside the three wires 2*a*, 2*b* and 2*c* is shown in FIG. 10F whereas the spacers 3*a*, 3*b*, and 3*c* being placed in-between the three wires 2*a*, 2*b* and 2*c* is shown in FIG. 10G.

In yet another embodiment of the invention, a ball bearing 3' binds the three wires 2*a*, 2*b* and 2*c* together as shown in FIG. 10H.

The FIGS. 10I-10L shows an embodiment of the invention in which the post 20 comprises of five wires 2*a*, 2*b*, 2*c*, 2*d* and 2*e*. As shown in FIG. 10I five spacers 3*a*, 3*b*, 3*c*, 3*d* and 3*e* are arranged outside the wires 2*a*, 2*b*, 2*c*, 2*d* and 2*e*. The arrangement of the spacers 3*a*, 3*b*, 3*c*, 3*d* and 3*e* inside the wires 2*a*, 2*b*, 2*c*, 2*d* and 2*e* is shown in FIG. 10J while the arrangement of the spacers 3*a*, 3*b*, 3*c*, 3*d* and 3*e* in-between the wires 2*a*, 2*b*, 2*c*, 2*d* and 2*e* is illustrated in FIG. 10K.

In yet another embodiment of the invention, a cylindrical block or plug 3' replaces the spacers 3*a*, 3*b*, 3*c*, 3*d* and 3*e* to bind together the wires 2*a*, 2*b*, 2*c*, 2*d* and 2*e* as shown in FIG. 10L.

FIG. 10M represents the wires 2*a*, 2*b*, 2*c* and 2*d* made from sections of two half-bent wires and the wires 2*a*, 2*b*, 2*c* and 2*d* being held together by a cylindrical block 3'.

In yet another embodiment of the invention, the cylindrical block 3' can have any other geometrical shape like oval, elliptical, rectangular etc.

In yet another embodiment of the invention, there can be a plurality of cylindrical blocks 3' to bind the wires 2*a*, 2*b*, 2*c* and 2*d* together.

FIG. 10N shows another possible design of the post 20 which is made up of three wires 2*a*, 2*b* and 2*c* rigidly joined to each other along their length. FIG. 10O depicts three wires 2*a*, 2*b* and 2*c* and a spacer 3*a* in the form of a ring enclosing the wires 2*a*, 2*b* and 2*c*. FIG. 10P depicts three wires 2*a*, 2*b* and 2*c* and a spacer 3*a* in the form of a ring held inside the wires 2*a*, 2*b* and 2*c*.

Figure 11A:
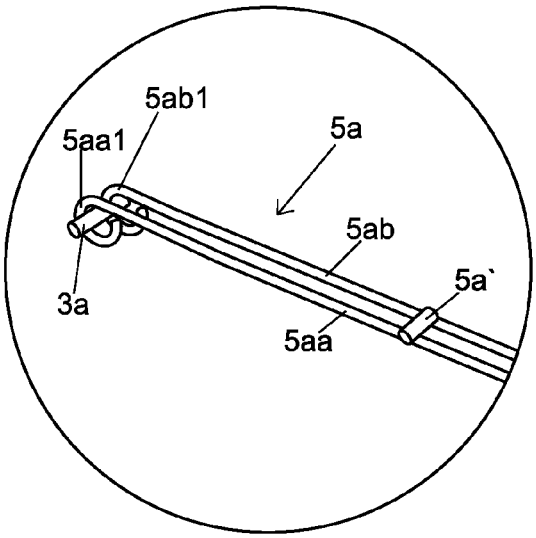
FIG. 11A-11D shows various design assembly of the arms of the umbrella frame.

FIG. 11A-11D shows various structural orientations which the arms 5*a*, 5*b*, 5*c* and 5*d* of the umbrella frame 10 can possess. FIG. 11A illustrates an arm 5*a* having to wires 5*aa* and 5*ab* with a spacer 5*a'* fixed intermediately on it. The wires 5*aa* and 5*ab* has one of their ends 5*aa*1 and 5*ab*1 twisted in the form of a hook and attached to the spacer 3*a*. Further, the wires 5*aa* and 5*ab* are lying in a horizontal plane with respect to each other.

Figure 11B:
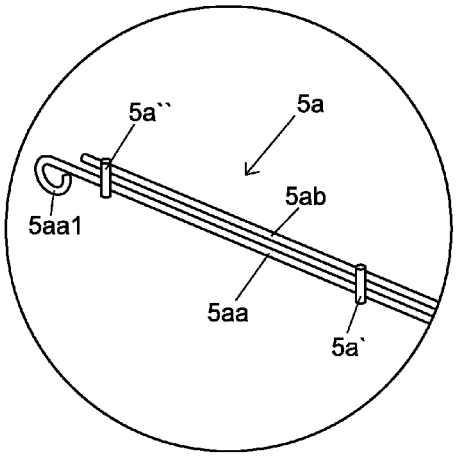

FIG. 11B shows an arm 5*a* with the two wires 5*aa* and 5*ab* in vertical orientation with respect to each other. Two spacers 5*a'* and 5*a'* are mounted on the arm 5*a*. The end 5*aa*1 of the wire 5*aa* is twisted in the form of a hook.

In yet another embodiment of the invention, the spacers 5*a'* and 5*a"* can be welded on the arm 5*a*.

In yet another embodiment of the invention, the arm 5*a* can have any plurality of spacers mounted on it.

Figure 11C:
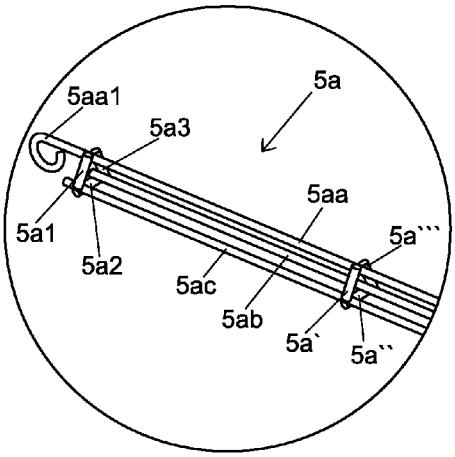
Figure 11D:
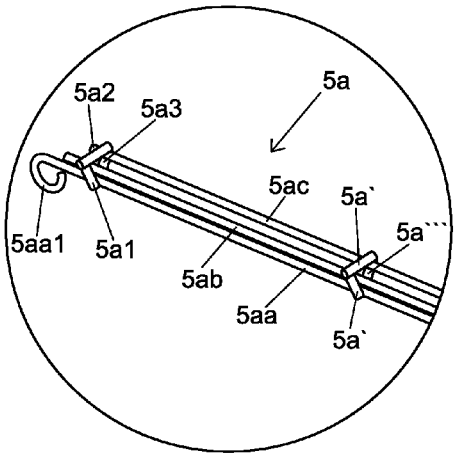

FIG. 11C and FIG. 11D show two different views of an arm 5*a* comprising of three wires 5*aa*, 5*ab* and 5*ac*. The wires 5*aa*, 5*ab* and 5*ac* are placed in a triangular orientation with respect to each other. Spacers 5*a'*, 5*a"* and 5*a'"* are fixed at an intermediate location on the wires 5*aa*, 5*ab* and 5*ac*. Another set of three spacers 5*a*1, 5*a*2, 5*a*3 are located on the arm 5*a* near its end. The spacers 5*a'*, 5*a"*, 5*a'"*, 5*a*1, 5*a*2 and 5*a*3 are fixed at an outside configuration on the three wires 5*aa*, 5*ab* and 5*ac*. The end 5*aa*1 of the wire 5*aa* is shaped in the form of a hook to be connected to the post. The spacers 5*a'*, 5*a"*, 5*a'"*, 5*a*1, 5*a*2 and 5*a*3 provide strength to the arm 5*a* and make it more resistant to bending and increases its overall mechanical stability.

In yet another embodiment of the invention, the spacers 5*a'*, 5*a"*, 5*a'"*, 5*a*1, 5*a*2 and 5*a*3 can be replaced by any supporting elements which serve the purpose of joining the wires 5*aa*, 5*ab* and 5*ac* together.

Figure 14A:
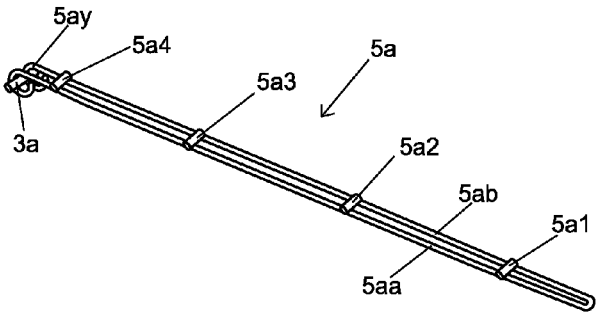
FIG. 14A illustrates four spacers distributed evenly along an arm.

FIG. 14A shows another embodiment of the invention in which a single arm 5*a* comprises of two wires 5*aa* and 5*ab*. The wires 5*aa* and 5*ab* are in half-bent configuration and have four spacers 5*a*1, 5*a*2, 5*a*3 and 5*a*4 affixed to the arm 5*a* in an outside position. The two wires 5*aa* and 5*ab* lie in a horizontal plane with respect to each other and one end 5*ay* of the arm 5*a* which comprises of the pair of wires 5*aa* and 5*ab* shaped in the form of a hook and connected to a spacer 3*a*.

Figure 14B:
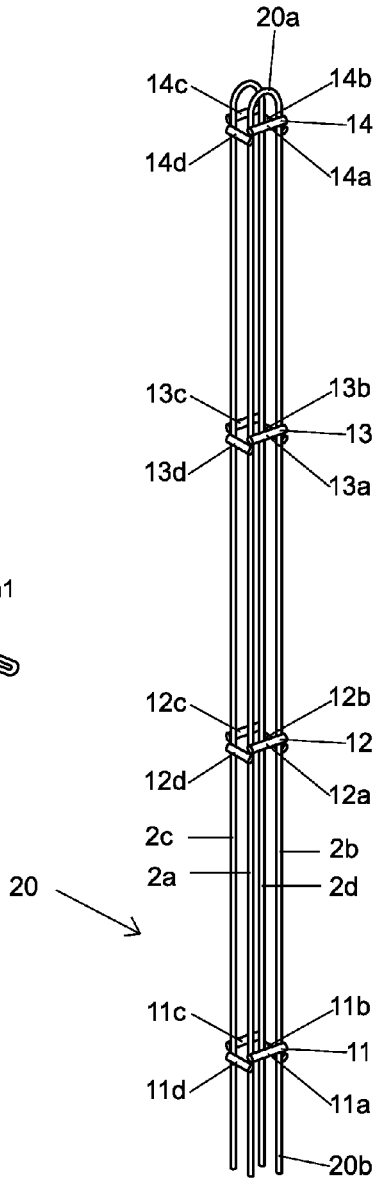
FIG. 14B illustrates four sets of spacers distributed evenly along the post.

FIG. 14B shows an embodiment of the invention in which the post 20 having a top end 20*a* and a bottom end 20*b* is made up of four wires 2*a*, 2*b*, 2*c* and 2*d*. The wires 2*a* and 2*b* are made from a single half -bent wire and the wires 2*c* and 2*d* are made from another single half-bent wire. Four set 11, 12, 13, 14 of four spacers each is placed along the length of the post 20. The set 11 comprises of four spacers 11*a*, 11*b*, 11*c* and 11*d*, the set 12 comprises of four spacers 12*a*, 12*b*, 12*c* and 12*d*, the set 13 comprises of four spacers 13*a*, 13*b*, 13*c* and 13*d* and the set 14 comprises of four spacers 14*a*, 14*b*, 14*c* and 14*d*. All the spacers 11*a*, 11*b*, 11*c*, 11*d*, 12*a*, 12*b*, 12*c*, 12*d*, 13*a*, 13*b*, 13*c*, 13*d*, 14*a*, 14*b*, 14*c* and 14*d* are affixed in an outside position with respect to the wires 2*a*, 2*b*, 2*c* and 2*d*.

In yet another embodiment of the invention, the spacers 11*a*, 11*b*, 11*c*, 11*d*, 12*a*, 12*b*, 12*c*, 12*d*, 13*a*, 13*b*, 13*c*, 13*d*,

14*a*, 14*b*, 14*c* and 14*d* can be affixed in an inside or in-between orientation with respect to the wires 2*a*, 2*b*, 2*c* and 2*d*.

In FIGS. 15A, 15B and 15C various methods are shown in which in the modular connector 6*a* can be attached to the arm 5*a*. In FIG. 15A the modular connector 6*a* having a first end 6*a*' and second end 6*a*" is attached to the arm 5*a* by having its first end 6*a*' hooked to a spacer 5*a*' lying intermediately on the arm 5*a*.The second end 6*a*" of the modular connector 6*a* will be connected to the lift ring 4 (not shown). Further, one end 5*ay* of the arm 5*a* which comprises of the pair of wires 5*aa* and 5*ab* shaped in the form of a hook and connected to a spacer 3*a*.

FIG. 15B illustrates an embodiment of the invention in which the arm 5*a* which comprises of two wires 5*aa* and 5*ab* wherein the wire 5*aa* has a loop formed at an intermediate position. The wires 5*aa* and 5*ab* are oriented in a vertical plane with respect to each other. Four spacers 5*a*', 5*a*", 5*a*'" and 5*a*"" are fixed on the arm 5*a* with two spacers on each vertical face of the arm 5*a*. The modular connector 6*a* has its first end 6*a*' hooked to the loop formed in the wire 5*aa*. The end 5*aa* 1 of the wire 5*aa* is shaped in the form of a hook to be connected to the post 20.

In yet another embodiment of the invention, the first end 6*a*' modular connector 6*a* can be hooked to two loops formed in the wires 5*aa* and 5*ab*.

In yet another embodiment of the invention, the wires 5*aa* and 5*ab* can have a plurality of loops formed on them.

FIG. 15C shows the wires 5*aa* and 5*ab* of the arm 5*a* in vertical orientation with respect to each other and two spacers 5*a*' and 5*a*" affixed to the arm 5*a*. The wire 5*aa* has a loop formed at an intermediate position and the first end 6*a*' of the modular connector 6*a* is hooked to the loop of the wire 5*aa* for being connected to the arm 5*a*. The end 5*ab* 1 of the wire 5*ab* is curved in the form of a hook to be connected to the post 20.

In yet another embodiment of the invention, the any number of spacers can be evenly distributed along the post and the arms.

Figure 16:
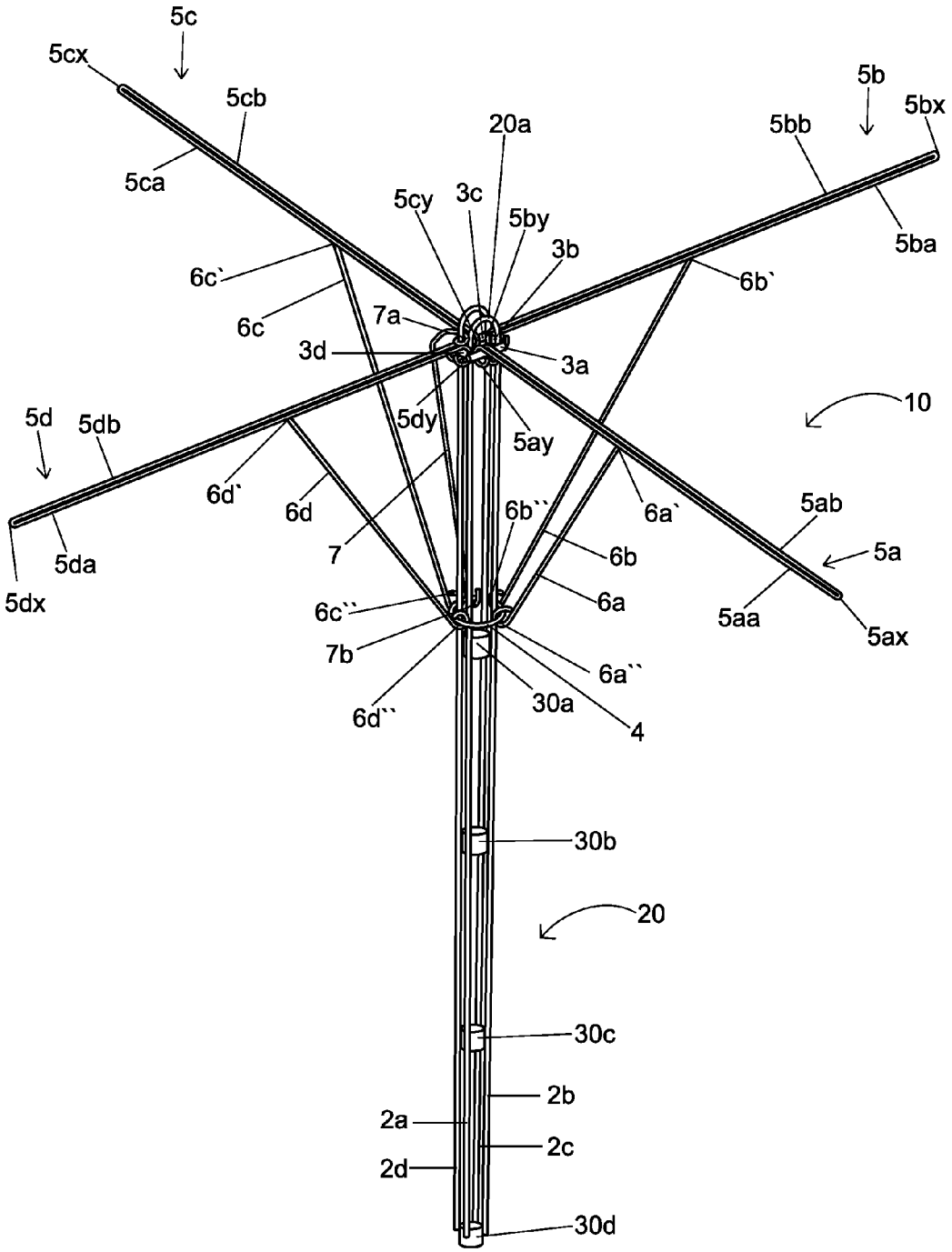
FIG. 16 shows an alternative embodiment of the umbrella frame with cylindrical blocks or plugs mounted along the post.

FIG. 16 shows an alternate embodiment of the umbrella frame 10 in which four cylindrical blocks 30*a*, 30*b*, 30*c* and 30*d* are placed longitudinally along the wires 2*a*, 2*b*, 2*c* and 2*d* of the post 20. The wires 2*a*, 2*b*, 2*c* and 2*d* are also bound to each other by four spacers 3*a*, 3*b*, 3*c* and 3*d* located near the top end 20*a* of the post 20.

The umbrella frame 10 further comprises of a movable lift ring 4 mounted circumferentially around the post 20. Four arms 5*a*, 5*b*, 5*c* and 5*d* are coupled to the post 20 proximally at its top end 20*a*. The arm 5*a* is made up of two wires 5*aa* and 5*ab* wherein the wires 5*aa* and 5*ab* are made from a single half-bent wire. Similarly the arms 5*b*, 5*c* and 5*d* comprises of two wires 5*ba*, 5*bb*; 5*ca*, 5*cb*; 5*da*, 5*db* each as shown in FIG. 16.

One end 5*ax*, 5*bx*, 5*cx* and 5*dx* of each of the arms 5*a*, 5*b*, 5*c* and 5*d* is curved due to the half-bent wire configuration of the arms 5*a*, 5*b*, 5*c* and 5*d* while the other ends 5*ay*, 5*by*, 5*cy* and 5*dy* wherein the end 5*ay* comprises of the pair of wires 5*aa*, 5*ab* being bent in the form of a hook and similarly the ends 5*by*, 5*cy* and 5*dy* 5*ba* comprises of the wires 5*ba*, 5*bb*; 5*ca*, 5*cb*; 5*da*, 5*db* respectively being bent in the form of a hook and connected to the spacers 3*a*, 3*b*, 3*c* and 3*d* respectively. This hook type attachment of the ends 5*ay*, 5*by*, 5*cy* and 5*dy* permits free rotation of the arms 5*a*, 5*b*, 5*c* and 5*d* along the spacers 3*a*, 3*b*, 3*c* and 3*d* respectively.

The umbrella frame 10 also includes four modular connectors 6*a*, 6*b*, 6*c* and 6*d*. Each of modular connector 6*a*, 6*b*, 6*c* and 6*d* has first ends 6*a*', 6*b*', 6*c*' and 6*d*' and second ends 6*a*", 6*b*", 6*c*" and 6*d*".The modular connector 6*a* has its first end 6*a*' directly connected to the arm 5*a* and its second end 6*a*" connected to the lift ring 4. Similarly the modular connectors 6*b*, 6*c* and 6*d* have their first ends 6*b*', 6*c*' and 6*d*' directly connected to the arms 5*b*, 5*c*, 5*d* and the second ends 6*b*", 6*c*" and 6*d*" connected to the lift ring 4. The movable lift ring 4 facilitates the opening and closing of the arms 5*a*, 5*b*, 5*c* and 5*d* by moving freely along the post 20.

In yet another embodiment of the invention, the first ends 6*a*', 6*b*', 6*c*' and 6*d*' of the modular connectors 6*a*, 6*b*, 6*c* and 6*d* are welded on the arms 5*a*, 5*b*, 5*c* and 5*d*.

In yet another embodiment of the invention, the first ends 6*a*', 6*b*', 6*c*' and 6*d*' of the modular connectors 6*a*, 6*b*, 6*c* and 6*d* can be fixed on the arms 5*a*, 5*b*, 5*c* and 5*d* by any suitable methods of joining two members.

A locking element 7 is shown in FIG. 16 having two ends 7*a* and 7*b* with the first end 7*a* being hooked to the post 20 near its top end 20*a* and the second end 7*b* hooked to the lift ring 4. The locking element 7 engages the post 20 and the lift ring 4 and functions to keep the arms 5*a*, 5*b*, 5*c* and 5*d* in the open position.

Figure 17:
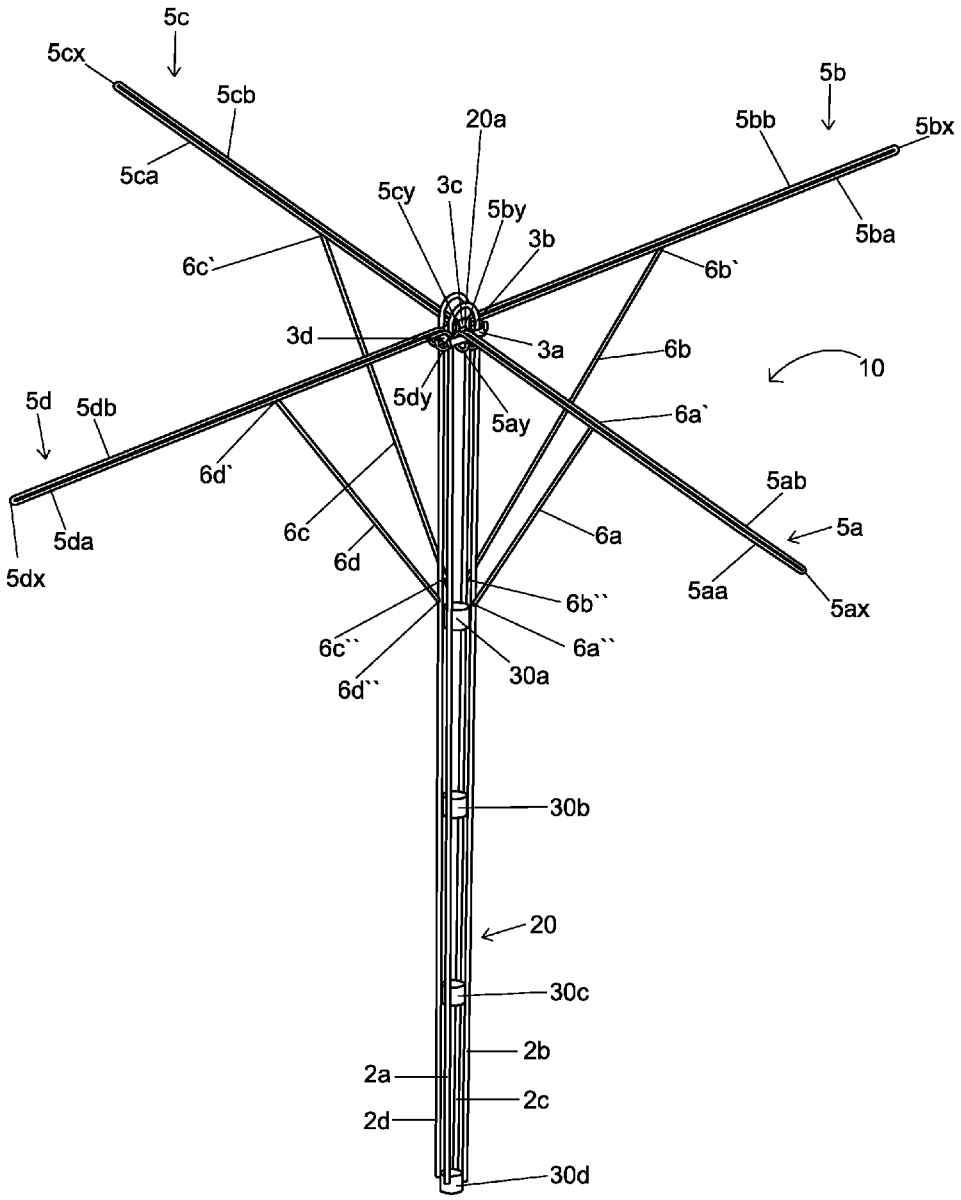
FIG. 17 illustrates another design assembly of the umbrella frame with the modular connectors directly fixed to the arms and the post.

FIG. 17 shows another modified embodiment of the umbrella frame 10 in which four cylindrical blocks 30*a*, 30*b*, 30*c* and 30*d* are placed longitudinally along the wires 2*a*, 2*b*, 2*c* and 2*d* of the post 20. The wires 2*a*, 2*b*, 2*c* and 2*d* are also bound to each other by four spacers 3*a*, 3*b*, 3*c* and 3*d* located near the top end 20*a* of the post 20.

The umbrella frame 10 further comprises of four arms 5*a*, 5*b*, 5*c* and 5*d* are coupled to the post 20 proximally at its top end 20*a*. The arm 5*a* is made up of two wires 5*aa* and 5*ab* wherein the wires 5*aa* and 5*ab* are made from a single half-bent wire. Similarly the arms 5*b*, 5*c* and 5*d* comprises of two wires 5*ba*, 5*bb*; 5*ca*, 5*cb*; 5*da*, 5*db* each as shown in FIG. 17.

One end 5*ax*, 5*bx*, 5*cx* and 5*dx* of each of the arms 5*a*, 5*b*, 5*c* and 5*d* is curved due to the half-bent wire configuration of the arms 5*a*, 5*b*, 5*c* and 5*d* and the other ends 5*ay*, 5*by*, 5*cy* and 5*dy* wherein the end 5*ay* comprises of two wires 5*aa*, 5*ab* being bent in the form of a hook and similarly the ends 5*by*, 5*cy* and 5*dy* 5*ba* comprises of two wires 5*ba*, 5*bb*; 5*ca*, 5*cb*; 5*da*, 5*db* each respectively being bent in the form of a hook and connected to the spacers 3*a*, 3*b*, 3*c* and 3*d* respectively.

The umbrella frame 10 also includes four modular connectors 6*a*, 6*b*, 6*c* and 6*d*. Each of modular connector 6*a*, 6*b*, 6*c* and 6*d* has first ends 6*a*', 6*b*', 6*c*' and 6*d*' and second ends 6*a*", 6*b*", 6*c*" and 6*d*" .The modular connector 6*a* has its first end 6*a*' directly connected to the arm 5*a* and its second end 6*a*" directly connected to the post 20. Similarly the modular connectors 6*b*, 6*c* and 6*d* have their first ends 6*b*', 6*c*' and 6*d*' directly connected to the arms 5*b*, 5*c*, 5*d* and the second ends 6*b*", 6*c*" and 6*d*" directly connected to the post 20.

In yet another embodiment of the invention, the first ends 6*a*', 6*b*', 6*c*' and 6*d*' and the second ends 6*a*", 6*b*", 6*c*" and 6*d*" of the modular connectors 6*a*, 6*b*, 6*c* and 6*d* are welded on the arms 5*a*, 5*b*, 5*c*, 5*d* and the post 20.

In yet another embodiment of the invention, the first ends 6*a*', 6*b*', 6*c*' and 6*d*' and the second ends 6*a*", 6*b*", 6*c*" and 6*d*" of the modular connectors 6*a*, 6*b*, 6*c* and 6*d* can be fixed on the arms 5*a*, 5*b*, 5*c*, 5*d* and the post 20 by any suitable methods of joining two members.

The umbrella frame 10 shown in FIG. 17 is of open umbrella category and will remain in open position.

Figure 18:
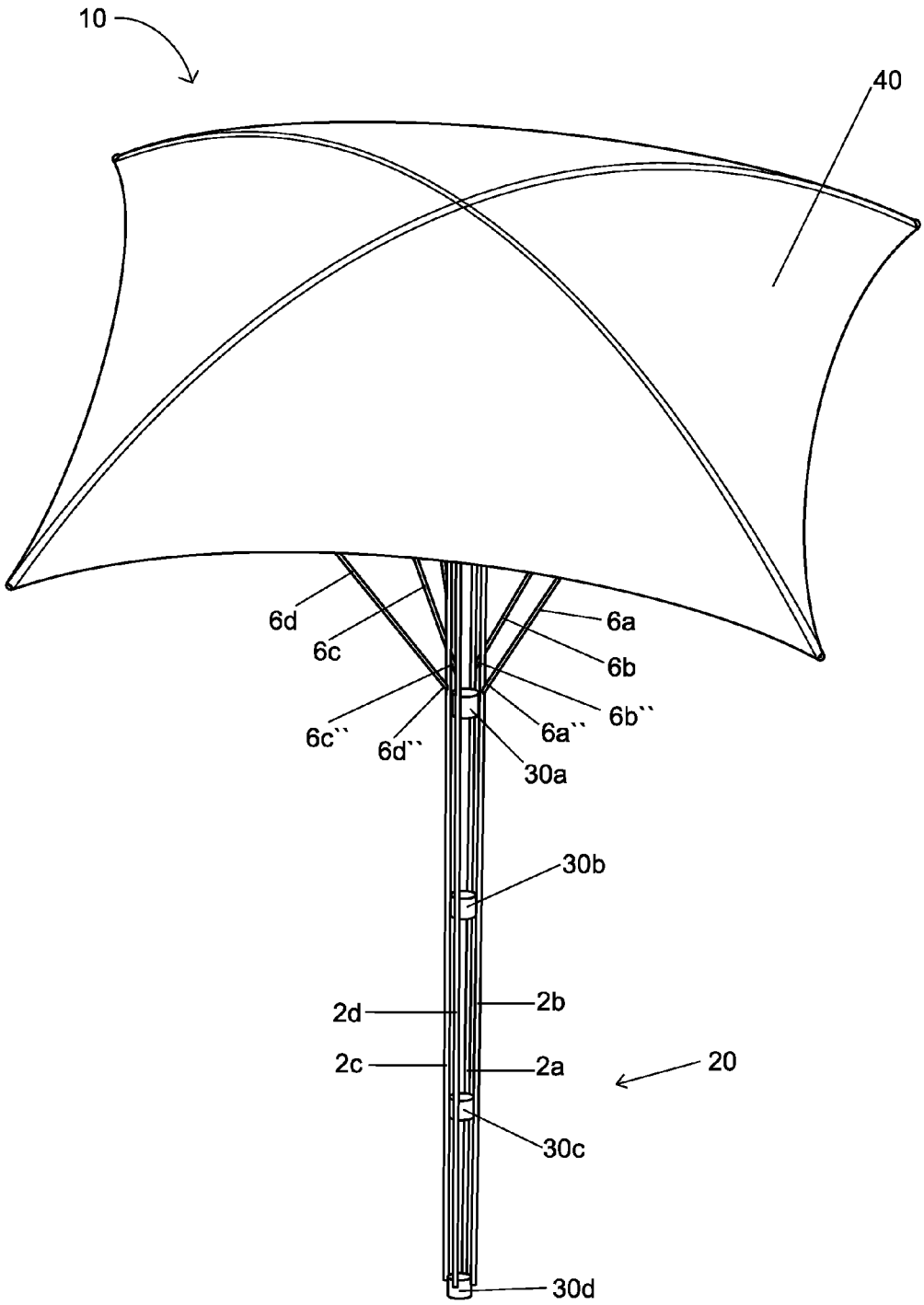
FIG. 18 illustrates a fabric cover affixed to the arms of an umbrella frame.

FIG. 18 depicts a working model of the umbrella frame 10 having a fabric cover 40 affixed to the arms 5*a* (not shown), 5*b* (not shown), 5*c* (not shown) and 5*d*(not shown) of the umbrella frame 10. Four cylindrical blocks 30*a*, 30*b*, 30*c* and 30*d* are placed longitudinally along the wires 2*a*, 2*b*, 2*c* and 2*d* of the post 20. Further, four modular connectors 6*a*, 6*b*, 6*c* and 6*d* having their second ends 6*a*", 6*b*", 6*c*" and 6*d*" directly connected to the post 20 can be seen in FIG. 18.

Figure 19:
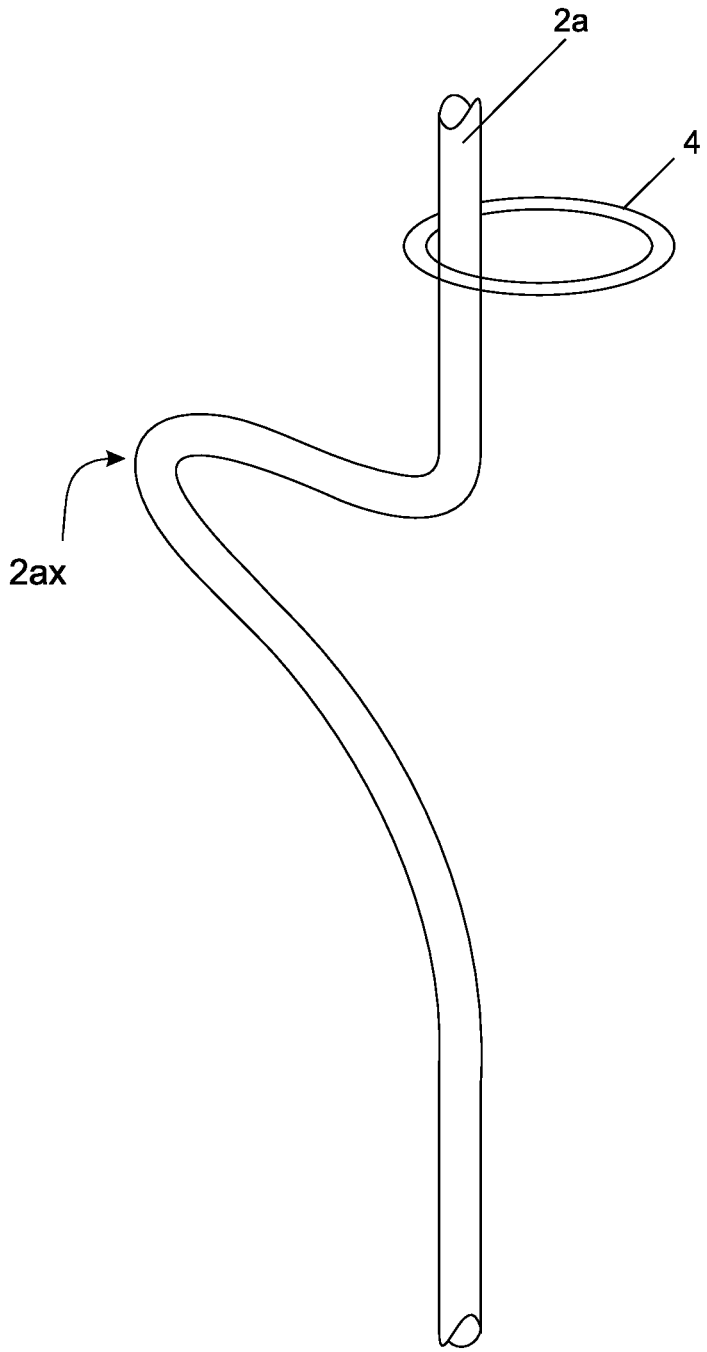
FIG. 19 illustrates a spring lock assembly in an alternative embodiment of the invention.

FIG. 19 depicts a spring lock mechanism in an alternative embodiment of the present invention. The wire 2*a* is pressed inwardly to create a locking bend 2*ax* which permits the ring 4 to slip over the locking bend and to retain the ring 4 in the upward position.

In yet another embodiment of the invention, multiple wires may include the spring lock structure of locking bend to retain the ring 4 in an upward position.

In yet another embodiment of the invention, the bending or twisting of the wire 2*a* can be done in any suitable shape or form to retain the ring 4.

Figure 20A:
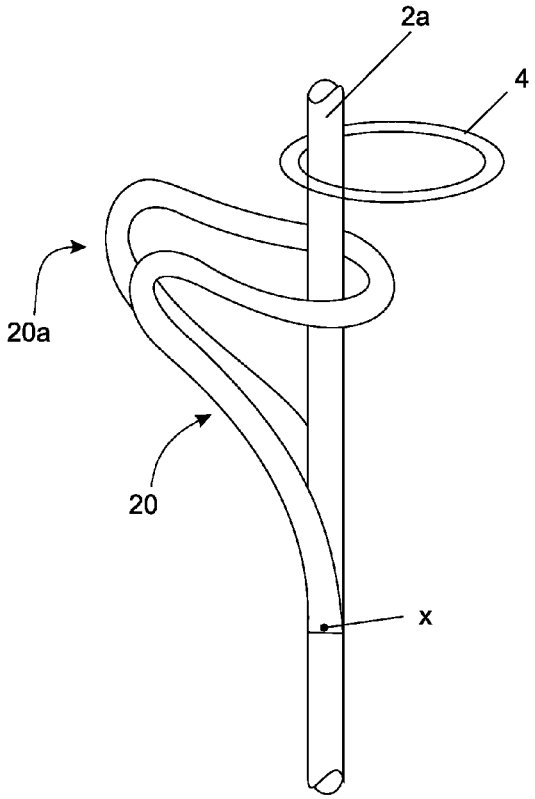
FIG. 20A-20B illustrates a modified spring lock assembly and its mechanism.
Figure 20B:
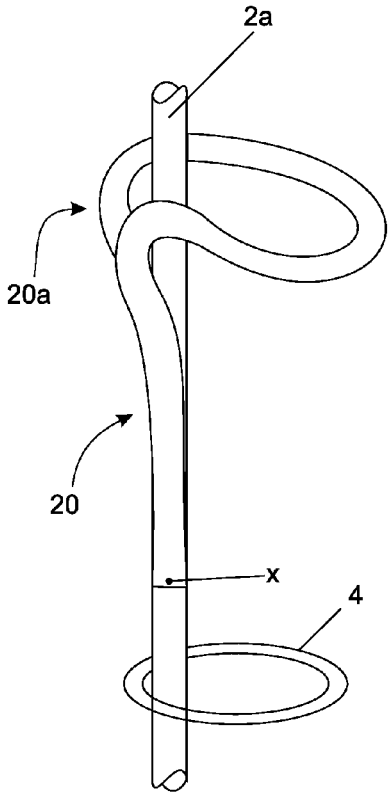

With reference to FIG. 20A and FIG. 20B another modified spring lock structure is discussed. As shown in FIG. 20A the spring lock assembly 20 comprises of a twisted wire 20*a* which is fixed to the wire 2*a* at location X. The spring lock assembly 20 can be fixed at location X by means of welding or any other joining method like use of fasteners, screw etc. The ring 4 is located at an upward position with respect to the spring lock assembly 20 in FIG. 20A. The fixation of lock assembly 20 at location X on the wire 2*a* permits the lock assembly 20 to move inwardly and outwardly with respect to the wire 2*a*. When it is desired to bring the ring 4 to a downward position the lock assembly 20 can be pressed inwards to come closer to the wire 2*a* and the ring 4 is passed over it and moved to a downwards position as shown in FIG. 20B.

In yet another embodiment of the invention, the spring lock assembly 20 can be attached to multiple wires of the umbrella frame.

The use of spacers in the present invention to join the plurality of wires in the post, arms and the modular connectors is of exemplary significance. The structure of the spacers between the plurality of wires for the post, arms and modular connectors provides additional strength against bending at a lower weight and mass of a solid member of the same outside dimensions. The application of spacers as a reinforcement member is being put to model use in the present invention and the increase in mechanical strength and stability provided to each component i.e. the post, arms and modular connectors with the use of spacers yields visible results and benefits. Thus, the spacers are an essential and necessary element of the present invention.

The umbrella frame 10 has the advantages of being easily assembled and manufactured. The locking mechanism used in the umbrella is relatively easy and the complete structure is lightweight and strong. The umbrella frame 10 lends greater strength and stability to the umbrella which increases its life and also its usage in extreme and challenging weather conditions. The umbrella can be easily closed by sliding down the lift ring 4 along the post 10 which reduces it space occupation while not in use. Further, the assembled wires can be replaced or fixed with ease, if incase any repair is required to the umbrella frame 10.

The umbrella frame 10 can be used in a variety of applications. This umbrella frame can be used in the day-to-day hand umbrella and the large, standing outdoor umbrellas which are commonly utilized at restaurants, bars, hotels, and other places that offer outdoor seating so as to shield people from the sun, as well as from other elements of nature, such as wind, light rain, etc. The umbrella frame can be built for small, medium as well as large sized umbrellas and sizes can range from 12 inches to 9 feet in diameter. The umbrella frame lends flexibility and rigidity to the umbrella structure and hence proves to be a better design.

The rigidity and density of all the parts of the umbrella frame 10 can be tempered for a desired flexibility as needed. The post, arms, lift ring and modular connectors may be comprised of metal, wood or fiberglass but not limited to these rigid compositions. Thermoplastic materials can also be used to fabricate the umbrella frame as they offer a degree of flexibility in the members of the umbrella frame. These plastics have a degree of flexibility, and distribute the impact energy on the frame through all of the plastic components of the umbrella. This increases the life of the umbrella frame 10 which is generally the more costly portion of an umbrella unit. The other materials of the wires used in making the post and the arms can be but not limited to wooden dowels, bamboo, small rigid tubing, PVC (Polyvinyl chloride), plastic etc.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An umbrella frame comprising:

a post having a top end and a bottom end, the post consisting of a plurality of first wires, said first wires disposed adjacent and parallel to each other, the post further includes a plurality of first spacers between said first wires, said first wires and first spacers fixedly bound together at a plurality of locations along the length of the post and defining an empty space between said first wires;

a plurality of arms each arm having an inner end rotatably coupled to the post promote the top end and an outer end, each arm consisting of a plurality of second wires, said second wires of each arm disposed adjacent and parallel to each other, each of said arms further including a plurality of second spacers between said second wires of each arm, said second wires and second spacers of each arm fixedly bound together at a plurality of locations along the length of each arm definition an empty space between said second wires;

a movable lift ring circumferentially and slidably mounted to the post and moveable between a lower position and an upper position;

a number of module connector members equal in number to the number of arms, each module connector member having a first end and a second end, the first end of each module connector member rotatably connected to one of said plurality of arms at a fixed intermediate location along the arm, the second end of each module connector member rotatably connected to a position on the lift ring corresponding to the orientation of the corresponding one of said plurality of arms; and a lock for removably securing the lift ring in the upper position whereby to prevent the lift ring from movement down the post;

said lift ring moveable from the lower closed position, where the umbrella arms are retracted along side the post, to the upper open position, whereby the umbrella arms are rotated upwardly with the outer ends of the arms spread apart and where said lift ring is moveable downward from the upper open positions back to the lower closed position.

2. The umbrella frame according the claim 1, wherein the first spacers and second spacers are located in-between the respective plurality of first wires and the second wires.

3. The umbrella frame according to claim 1, wherein the second wires of each arm are oriented in a vertical plane with respect to each other.

4. The umbrella frame according to claim 1, wherein the lift ring moves upwardly along the post causing the module connector member to move toward the post top causing the respective arms to rotate upwardly and outwardly thereby opening the arms and wherein the lift ring moves downwardly along the post causing the module connector member to move towards the post bottom causing the respective arms to rotate downwardly and inwardly thereby closing the arms.

5. The umbrella frame according to claim 1, further comprising a fabric cover affixed the arms of the frame.

* * * * *